US012163198B2

(12) United States Patent
Sohn et al.

(10) Patent No.: US 12,163,198 B2
(45) Date of Patent: Dec. 10, 2024

(54) HYDROGEN REDUCTION OF IRON ORE CONCENTRATE IN LOOSE LAYERS AND COMPACTS

(71) Applicant: UNIVERSITY OF UTAH RESEARCH FOUNDATION, Salt Lake City, UT (US)

(72) Inventors: Hong Yong R. Sohn, Salt Lake City, UT (US); Syamantak Roy, Tucson, AZ (US)

(73) Assignee: University of Utah Research Foundation, Salt Lake City, UT (US)

( * ) Notice: Subject to any disclaimer, the term of this patent is extended or adjusted under 35 U.S.C. 154(b) by 0 days.

(21) Appl. No.: 18/069,601

(22) Filed: Dec. 21, 2022

(65) Prior Publication Data

US 2024/0026475 A1 Jan. 25, 2024

Related U.S. Application Data

(60) Provisional application No. 63/389,795, filed on Jul. 15, 2022.

(51) Int. Cl.
*C21B 13/00* (2006.01)

(52) U.S. Cl.
CPC ..... *C21B 13/004* (2013.01); *C21B 13/0033* (2013.01); *C21B 13/0073* (2013.01)

(58) Field of Classification Search
CPC ..... C21B 13/004; C21B 13/0033; C21B 13/0073
USPC ..... 75/756
See application file for complete search history.

(56) References Cited

FOREIGN PATENT DOCUMENTS

| | | | | |
|---|---|---|---|---|
| CN | 110000396 | A | | 7/2019 |
| CN | 112159880 | A | | 1/2021 |
| CN | 113930568 | A | | 1/2022 |
| CN | 114107592 | A | | 3/2022 |
| CN | 114410873 | A | | 4/2022 |
| CN | 114713835 | A | * | 7/2022 |
| GB | 0776260 | A | | 6/1957 |

(Continued)

OTHER PUBLICATIONS

CN-114713835-A Translation (Year: 2022).*

(Continued)

*Primary Examiner* — Brian D Walck
*Assistant Examiner* — Danielle M. Carda
(74) *Attorney, Agent, or Firm* — Workman Nydegger

(57) ABSTRACT

An alternative approach to producing iron from iron concentrates produced from low grade iron ore without going through pelletization and induration. Such a method may include providing iron ore concentrate in a small particle form, passing the iron ore concentrate through a moving bed conveyor reduction furnace with at least one of hydrogen or natural gas, wherein the concentrate is present in a layer that is no more than about 5 cm thick, the hydrogen gas or natural gas reducing the concentrate so as to remove oxygen therefrom, converting the iron ore concentrate to iron that has a composition similar to direct reduced iron (DRI) or sponge iron product, having about 90-95% iron, up to about 10% oxygen, with other trace impurities. Energy consumption is reduced by 30-50% and $CO_2$ emissions are reduced by 60-95%, depending on whether natural gas or hydrogen is used.

9 Claims, 16 Drawing Sheets

(56) References Cited

FOREIGN PATENT DOCUMENTS

| | | |
|---|---|---|
| GB | 1175985 A | 1/1970 |
| GB | 1217842 A | 12/1970 |

OTHER PUBLICATIONS

Sahoo et al. Processing of banded magnetite quartzite (BMQ) ore using flotation techniques, Powder Technology 256, pp. 285-292, 2014 (Year: 2014).*
Surface Combustion, Belt Furnace, 2023 (Year: 2023).*
Ebben, Alex, Co-current vs. Counter Current: Kiln Air Flow, Nov. 7, 2017 (Year: 2017).*
Choi et al., "Development of green suspension ironmaking technology based on hydrogen reduction of iron oxide concentrate: rate measurements," Ironmaking and Steelmaking, 2010, 37(2), 81-88.
Fan et al., "Computational Fluid Dynamics Simulation of the Hydrogen Reduction of Magnetite Concentrate in a Laboratory Flash Reactor," Metallurgical and Materials Transactions B, 2016, 13 Pages.
He et al. "Direct reduction of fine iron ore concentrate in a conical fluidized bed." Powder technology 313 (2017), 46 Pages.
Li et al., "The Direct Reduction of Iron Ore with Hydrogen," Sustainability, 2021, 13, 8866, 15 Pages.
Si et al., "Phase transformation and reduction kinetics during the hydrogen reduction of ilmenite concentrate." International Journal of Minerals, Metallurgy, and Materials 19.5 (2012): 384-390.
Spreitzer et al., "Reduction of Iron Oxides with Hydrogen—A Review, steel research international." (2019): 1900108, 17 Pages.
Wang et al., "Hydrogen reduction kinetics of magnetite concentrate particles relevant to a novel flash ironmaking process." Metallurgical and Materials Transactions B 44.1 (2013): 133-145.

* cited by examiner

FIG. 9A
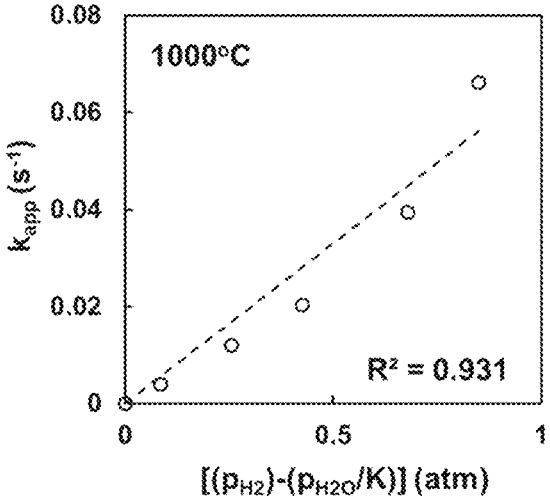
FIG. 9B
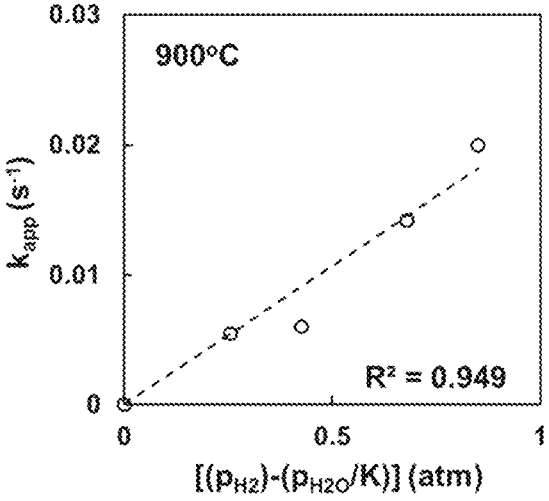
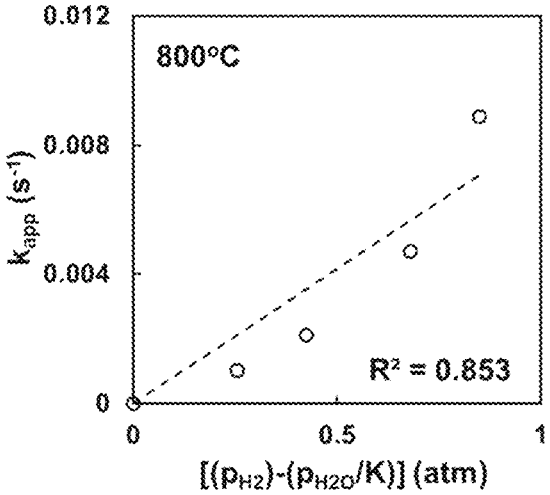
FIG. 9C
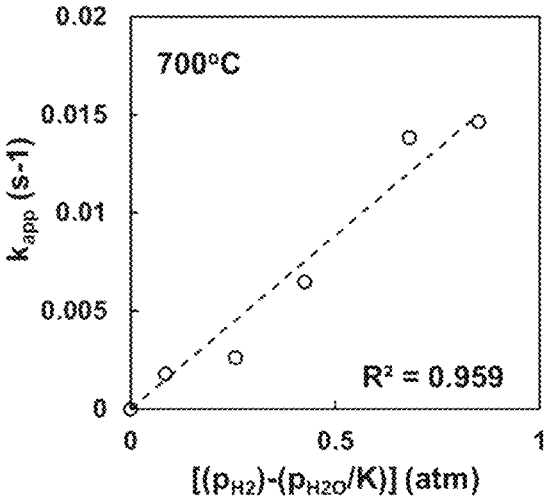
FIG. 9D

FIG. 10A
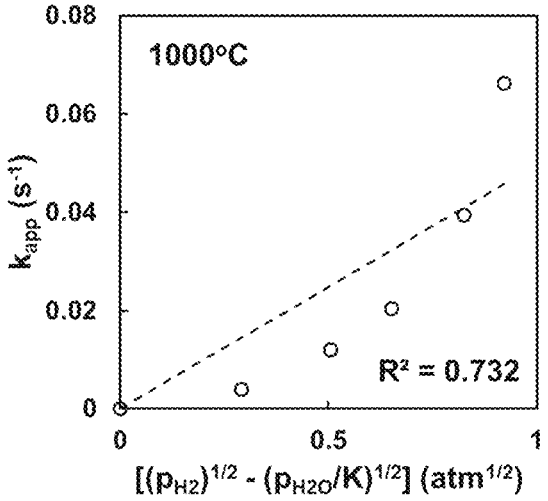
FIG. 10B
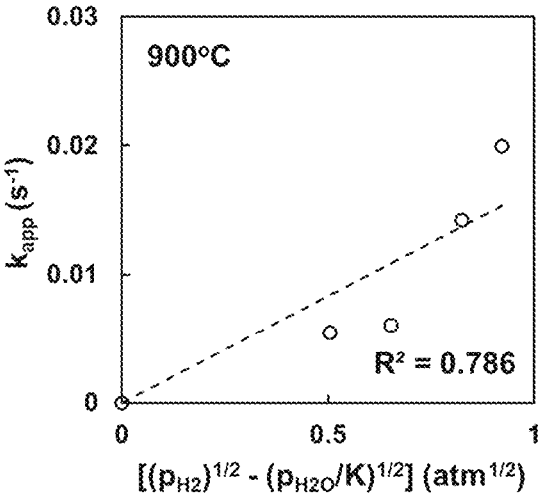
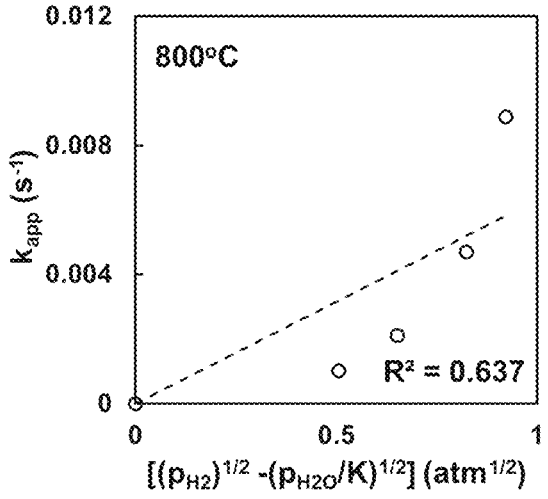
FIG. 10C
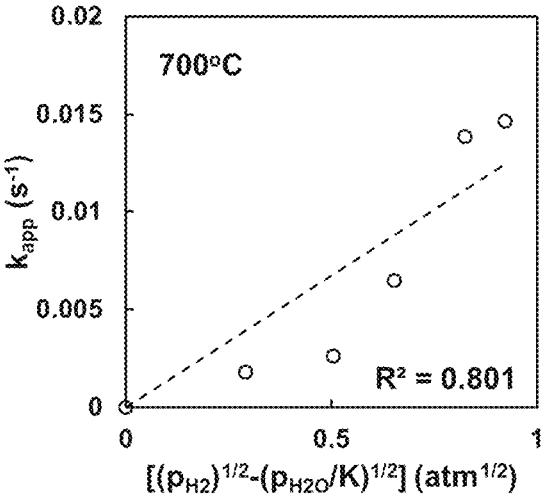
FIG. 10D

FIG. 15A
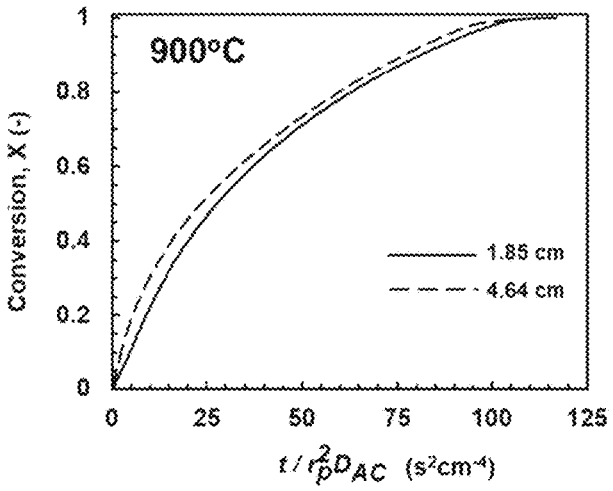
FIG. 15B
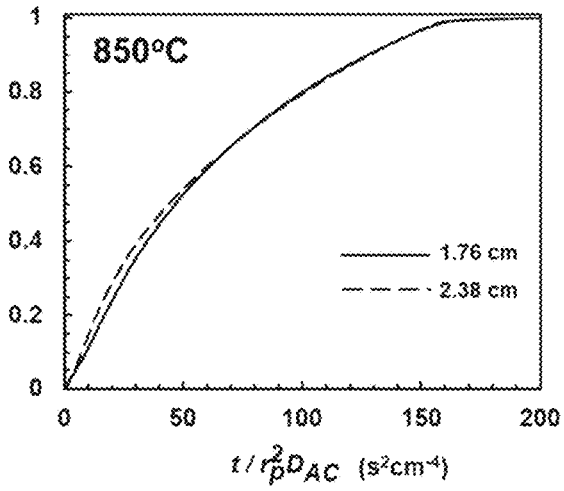
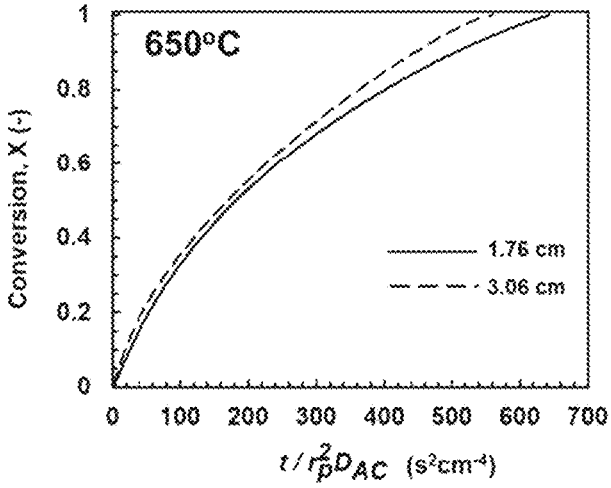
FIG. 15C

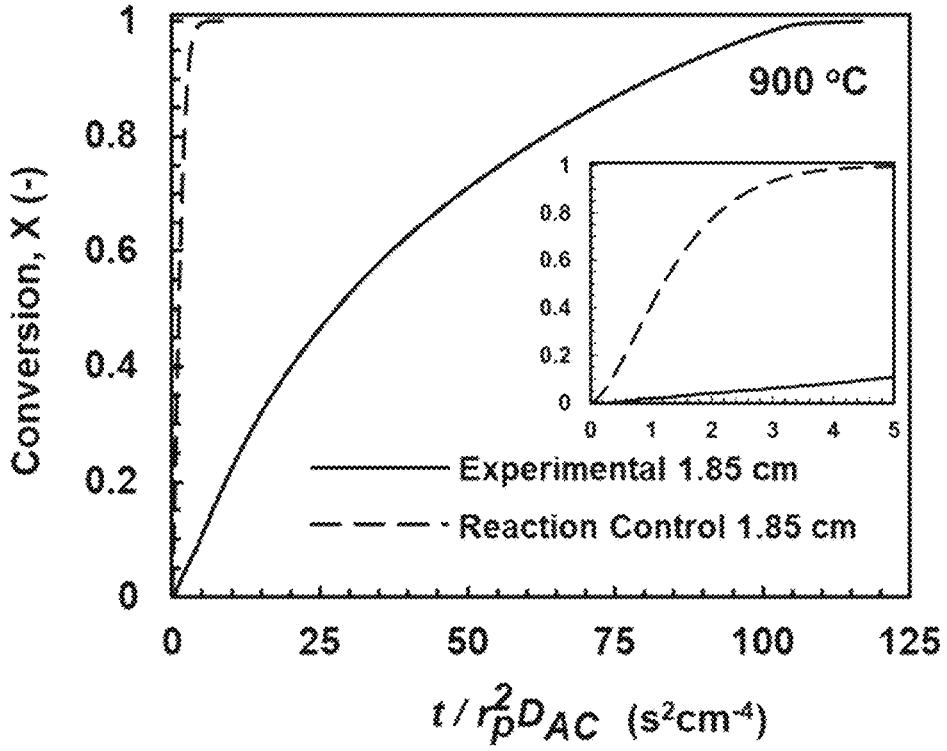
FIG. 16
FIG. 17A
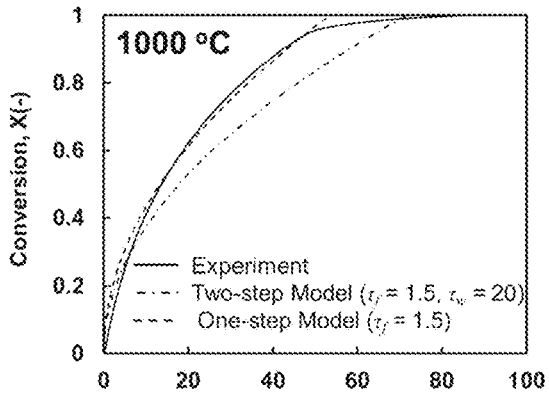
FIG. 17B
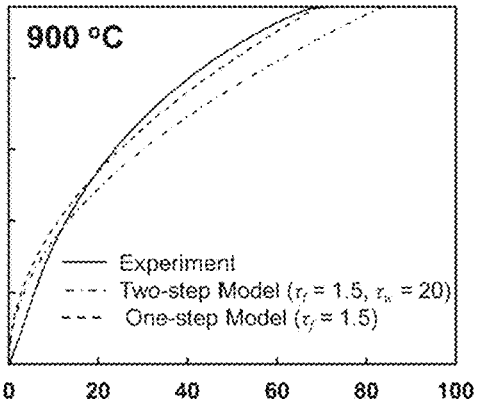
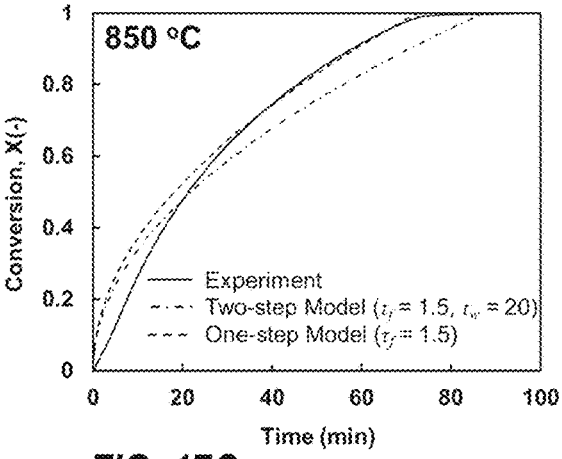
FIG. 17C
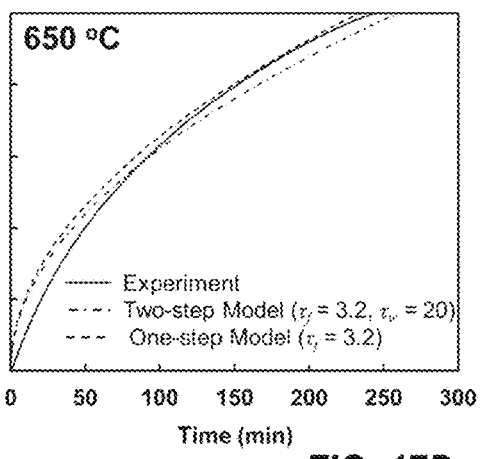
FIG. 17D FIG. 18A
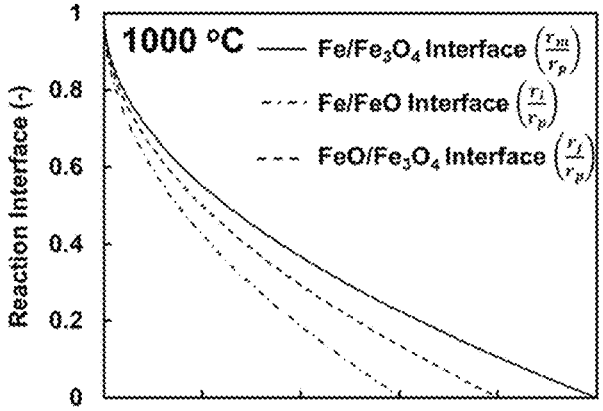
FIG. 18B
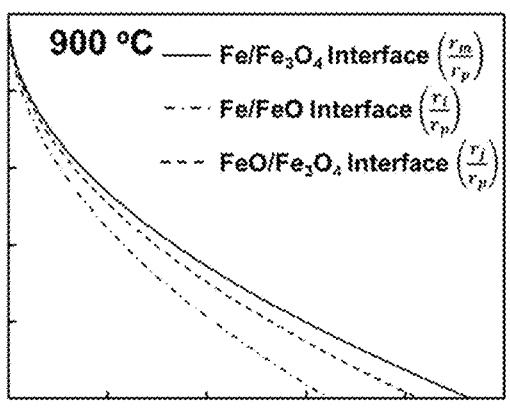
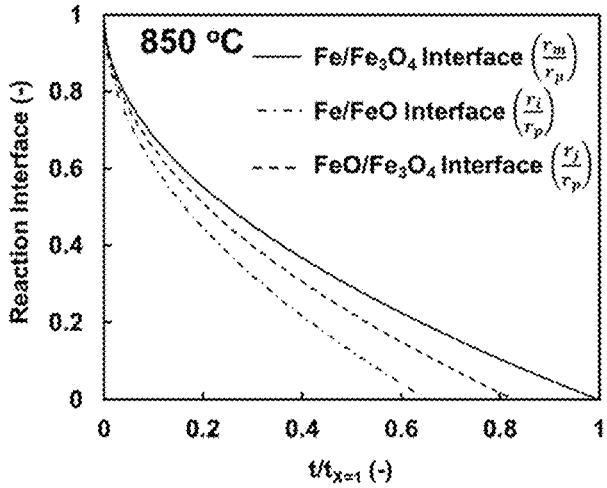
FIG. 18C
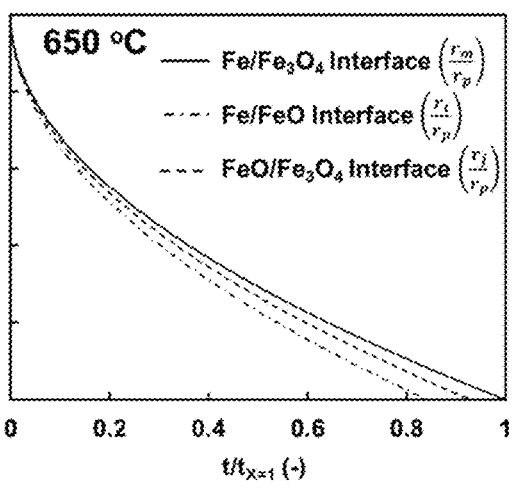
FIG. 18D
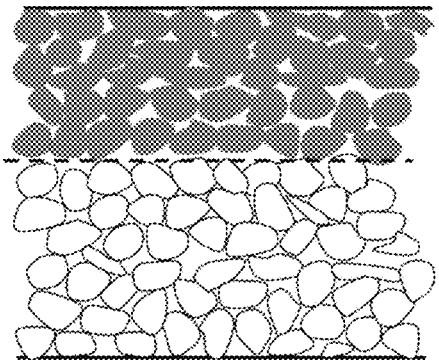
FIG. 19A
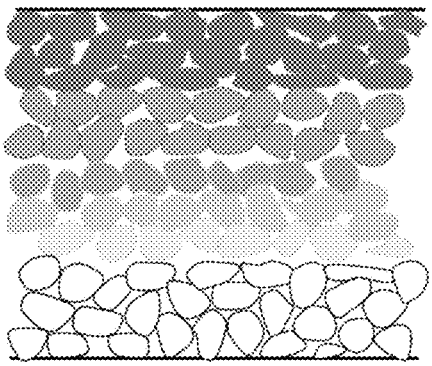
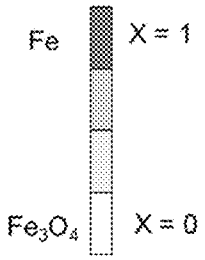
FIG. 19B FIG. 20A
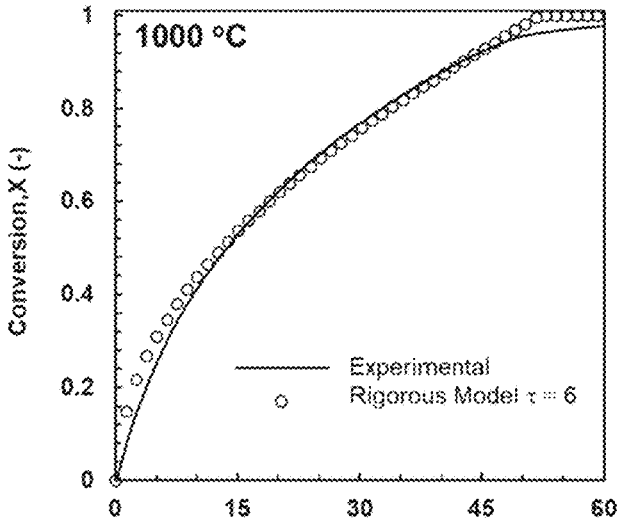
FIG. 20B
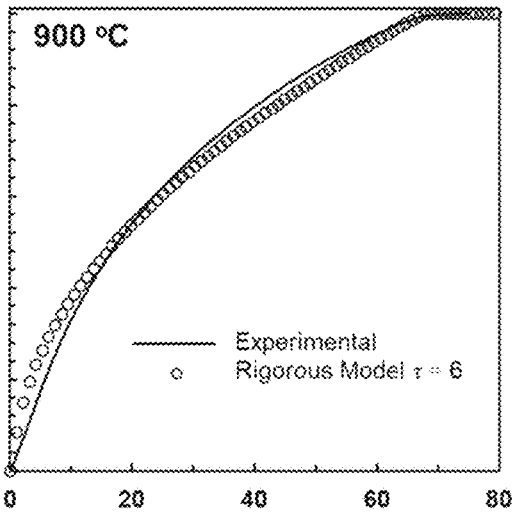
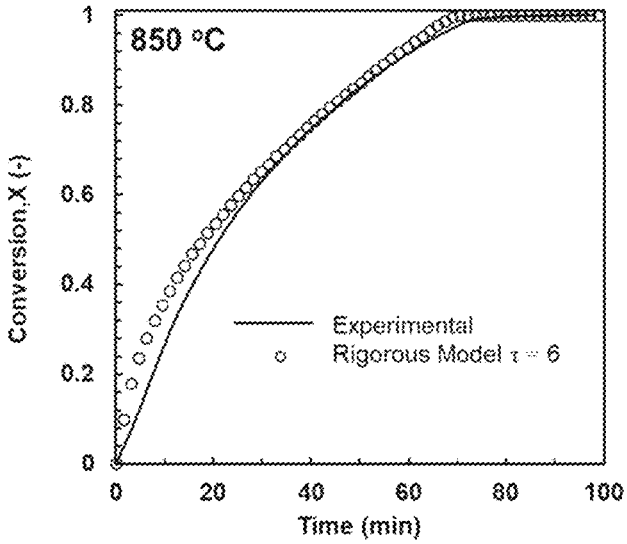
FIG. 20C
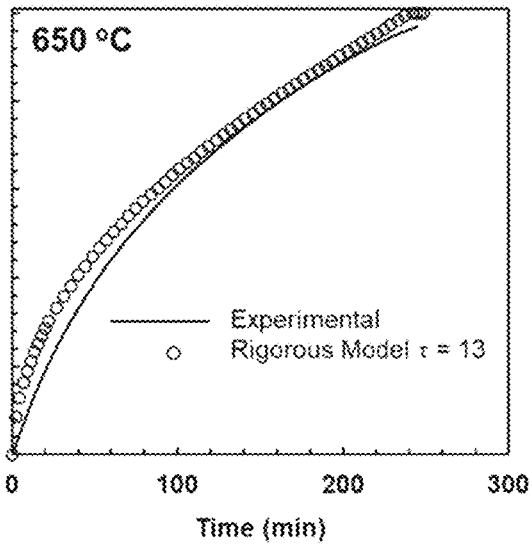
FIG. 20D

HYDROGEN REDUCTION OF IRON ORE CONCENTRATE IN LOOSE LAYERS AND COMPACTS

CROSS-REFERENCE TO RELATED APPLICATIONS

The present application claims the benefit under 35 U.S.C. 119(e) of U.S. Application No. 63/389,795, filed Jul. 15, 2022, entitled HYDROGEN REDUCTION OF IRON ORE CONCENTRATE IN LOOSE LAYERS AND COMPACTS, which is herein incorporated by reference in its entirety.

BACKGROUND OF THE INVENTION

1. The Field of the Invention

The present invention generally relates to hydrogen reduction of iron ore concentrate.

2. Background and Relevant Art

The most common forms of iron ores used in ironmaking are hematite ($Fe_2O_3$) and magnetite ($Fe_3O_4$). Ironmaking is the largest metal extraction process, and a blast furnace (BF) is used in traditional ironmaking. The BF technology is the most commercially successful ironmaking technology. In 2018, 1.2 billion metric tons of hot metal (molten iron) were produced worldwide, and about 95% of it was made using blast furnaces (BF).

BF ironmaking involves three main steps: sintering/pelletization of iron ore, coke-making, and reduction in a shaft reactor. All the steps in BF technology are energy-intensive processes and also prone to produce hazardous emissions along with large quantities of $CO_2$, the main greenhouse gas. At the current rate of production, the BF is responsible for the largest share of $CO_2$ emitted by the manufacturing industry, and the worldwide demand for steel is expected to rise in the coming years. As a result of $CO_2$ environmental and sustainability concerns, alternative ironmaking processes are being developed that can operate with lower quality feeds, are less energy intensive, and cut down on $CO_2$ emissions.

Many alternative ironmaking processes have been proposed in an attempt to address one or more of the following issues: high capital cost, high energy requirement, hazardous emissions, and by-products. Some of these processes have been successfully commercialized and have been able to replace the cokemaking process, lowered energy requirements and $CO_2$ emissions, and have been able to use iron ore fines. In spite of such recent incremental successes in alternative ironmaking processes, BF technology is still the predominant industrial method employed. As such, there is a continuing need to reduce energy consumption, greenhouse gas emissions, and costs in steelmaking. The development of alternative reactor systems, and use of alternative reducing species could greatly reduce generation of greenhouse $CO_2$ emissions and energy consumption. While hydrogen and other less carbon intensive fuels are used in some existing processes, such existing solutions only provide small incremental improvements, rather than a transformative solution that would be simple and robust.

BRIEF SUMMARY OF THE INVENTION

The predominance of BF technology provides a window of opportunity for alternative ironmaking research. In order to eliminate direct carbon emissions from steelmaking, a number of technologies are being developed around the world.

One such proposal, flash ironmaking technology (FIT) has been developed at the University of Utah. The present disclosure is directed to another hydrogen ironmaking technology. In the presently proposed ironmaking process, iron is produced directly from iron ore concentrates by a gas-solid reaction in a moving bed process using a stream of hydrogen as the reductant in the temperature range of about 500 to about 1000° C.

In the previously developed FIT, very fast rate of reduction was achieved by using very small iron concentrate particles at a high temperature of reduction. There is a limit to which temperature can be increased without undesirable issues related to high energy consumption, the refractory and other materials required for such high temperature operation, and the operation of such a reactor. Additionally, the FIT reactor was a co-current flow reactor where both the reducing gas and the iron ore concentrate particles enter the reactor at one end and exit together from the opposite end. Thus the gas utilization is determined by the wüstite-iron-hydrogen-water vapor equilibrium. The use of a counter-current moving bed reactor as proposed herein improves utilization of the expensive hydrogen gas (or natural gas). The alternative approach proposed herein includes a loose bed of iron ore concentrate which is reduced by a counter-current stream of hydrogen flowing thereover, and the reduction temperature will be such that interparticle diffusion will largely control the reduction rate. This will be the fastest possible reaction rate that can be achieved under this arrangement because for reactions occurring under the control of interparticle diffusion, the rate does not increase any further with an increase in temperature.

The main advantages of this proposed ironmaking technology are as follows:

1. Iron ore concentrate will be used directly without any significant pre-treatment. The iron ore concentrate can optionally be formed into loose bricks or pellets, but most economically, the iron ore concentrate may simply be provided as a loose layer of unsintered particles, and will be fed into the reactor in either a moving grate configuration or loaded onto trays on a moving conveyor belt. This will eliminate the cost and emissions associated with agglomeration processes like sintering and pelletization.
2. The operating temperature for this process is between 500-1000° C., which is much lower compared to reduction temperatures required in a BF and even some alternative ironmaking technologies. Such decreased temperature significantly reduces operating costs. Residence time in the moving bed reactor is on the order of several minutes (e.g., 1-15 minutes, or 5-15 minutes), which is significantly faster than that associated with conventional blast furnace reduction.
3. The reactor is rather simple and its operation is robust.
4. Where hydrogen gas is used as the reductant, there are no direct $CO_2$ emissions associated with the present process. Use of natural gas (e.g., $CH_4$) as the reductant may provide at least a 60% reduction in $CO_2$ emissions, as compared to conventional reduction in a blast furnace with coke.

In an embodiment, the present invention is directed to the production of iron from iron ore concentrate in a continuous moving bed reactor (e.g., a conveyor reactor). Such a reactor may be configured such that the moving bed moves horizontally. The process does not require sintering or pelletization and induration for iron concentrate type feedstocks, which sintering or pelletization and induration consumes a significant amount of energy and emits a significant volume of $CO_2$. It does not require coke for reduction, which emits significant amounts of $CO_2$ during production and use, and consumes excessive energy during production. It uses a moving bed similar to a rotary hearth furnace or a sinter bed machine. Such configurations will be familiar to those of skill in the art, as they are employed in other industrial processes.

In contrast to alternative processes described in the literature, the presently contemplated process employs a simple moving bed (e.g., conveyor) reactor, rather than a fluidized bed, suspension reduction, flash reduction, processes with extensive residence times (e.g., hours), a shaft furnace such as in a blast furnace, a specialized shaft furnace where oxygen and hydrogen are injected into the reduction section of the shaft furnace, or a rotary kiln and associated hydrogen spray gun and rotary cooling cylinder, as described in Li et al., "The Direct Reduction of Iron Ore with Hydrogen," Sustainability, 2021, 13, 8866; Choi et al., Ironmaking and Steelmaking, 2010, 37(2), 81-88; He et al., Powder Technology (2017); Si et al., "Phase transformation and reduction kinetics during the hydrogen reduction of ilmenite concentrate." International Journal of Minerals, Metallurgy, and Materials 19.5 (2012): 384-390; Wang et al., "Powder Technology Hydrogen reduction kinetics of magnetite concentrate particles relevant to a novel flash ironmaking process." Metallurgical and Materials Transactions B 44.1 (2013):133-145; Fan et al., "Computational Fluid Dynamics Simulation of the Hydrogen Reduction of Magnetite Concentrate in a Laboratory Flash Reactor," Metallurgical and Materials Transactions B, 2016; GB 1175985 to Hay et al; or CN113930568 to Wei et al. While such references may suggest the use of hydrogen in some instances, for reduction of an iron ore material, they do not teach or suggest a simple and robust process as described herein, that would use a moving bed conveyor reactor, where a relatively thin layer of iron concentrate, in small, particle form (e.g., that has not been pelletized) is quickly reduced within such a conveyor furnace with hydrogen, to form an upgraded iron material having significantly reduced oxygen concentration, ready for use in steelmaking in the same way that the material produced from a conventional coke fueled blast furnace would be ready for use in steelmaking. The present processes thus present an alternative route to iron reduction, particularly for specific iron ore materials, known as iron concentrate (e.g., such as produced from the low grade Taconite ores found in Minnesota and Michigan). The present processes are particularly tailored for use with iron concentrates produced from such low grade iron ore materials, that only include, e.g., up to about 35% iron by weight (e.g., 15-35% iron, or 20-35% iron, or 20-30% iron in the ore).

Such materials are in contrast to higher grade iron ores, such as "natural lump ore" (which may include 65-70% iron) or "high grade iron ore" (which may include 50-60% iron). Iron "concentrate" such as that produced from Taconite normally must be pelletized and indurated, in preparation for reduction in a blast furnace, with coke, or by reducing gases in a shaft furnace, in solid state. Such pelletization is required in such existing processes in order to ensure that the stacked bed of such material in the blast furnace will be able to withstand the pressure associated with such a stack of the pelletized material, as it undergoes reduction. The pellets must both be porous, so that the desired reduction of the iron material can occur (where oxygen and other impurities present are removed), as well as sufficiently strong so as to not simply be crushed and broken during such a process in the blast furnace.

The process of pelletizing and induration of such iron concentrate (e.g., from Taconite) is energy intensive, and generates significant emissions of $CO_2$. Nevertheless, such processes are important in locations such as North America, where there are no significant deposits of natural lump ore, or high grade iron ore. The existing processes which have been developed allow production of steel and other iron products from such low grade materials (e.g., which include no more than 35% iron, or no more than about 30% iron) available in North America. Similar low grade iron ore deposits exist elsewhere in the world (e.g., China), which have yet to be exploited, due to the difficulties associated with upgrading such materials. As a result, much of the steel produced in China is not produced from native Chinese low grade ores, but from higher grade materials shipped into China, e.g., from Australia and Brazil. The presently described processes would provide a process to utilize low grade iron ores in North America, or other countries (e.g., China), while minimizing energy consumption, and reducing greenhouse gas $CO_2$ emissions.

The invention uses iron ore concentrate produced from low grade ores without going through any pelletization and induration step. Energy consumption is reduced by about 30-50% compared with conventional blast furnace reduction. $CO_2$ emissions are reduced by 60-95%, or even substantially 100%, depending on whether natural gas (e.g., principally $CH_4$) or hydrogen (e.g., produced without carbon footprint) is used as the reductant and fuel. For example, the same material used as the reductant may be used as a fuel in order to provide the desired operating temperature, for the reduction reaction (e.g., about 500-1000° C.). Of course, any other fuel may also be suitable for use, as well, to achieve the desired temperature. The process equipment required to perform such a process is much simpler than current blast furnace facilities, thus reducing capital and operating costs. The invention permits large-scale use of large volumes of hydrogen, contributing significantly to the development of a hydrogen economy, with its attendant environmental and energy benefits.

In an embodiment, an exemplary method for producing iron from iron concentrate produced from low grade iron ore including no more than about 35% iron in a continuous moving bed conveyor reactor may include the steps of: (a) providing iron ore concentrate in a small particle form (e.g., where the longest dimension is no more than about 0.1 mm, or no more than 0.05 mm in size), where the iron ore concentrate has not undergone pelletization and/or induration; (b) passing the iron ore concentrate that has not undergone pelletization and/or induration through a moving bed conveyor reduction furnace with at least one of hydrogen gas or natural gas, wherein the iron ore concentrate that has not undergone pelletization and/or induration is present within the conveyor reduction furnace in a layer that is no more than about 5 cm, or no more than about 3 cm thick (e.g., 1-5 cm thick), the hydrogen gas or natural gas reducing the iron ore concentrate, so as to remove oxygen therefrom, and converting the iron ore concentrate material to a material having a composition similar to direct reduced iron (DRI) or sponge iron product, having about 90-95% iron by weight, up to about 10% oxygen by weight, optionally with other trace impurities (e.g., principally sulfur). While iron ore concentrate may be processed as described herein, where the particles are no more than about 0.1 mm in size, it will be appreciated that larger sized particles e.g., upgraded mm-sized iron ore particles, e.g., having sizes up to 0.5 mm, or even up to 1 mm may be processed in a similar manner, e.g., by operating at the upper end of the temperature range, or even somewhat higher than 1000° C., at higher temperatures and longer residence times than for the smaller particle sizes or no more than 0.1 mm.

Another embodiment is directed to a system for producing iron from iron concentrate produced from low grade iron ore including no more than about 35% iron in a continuous moving bed conveyor reactor, the system comprising: a moving bed conveyor reduction furnace into which is fed: (i) at least one of hydrogen gas or natural gas; and (ii) iron ore concentrate in a small particle form (e.g., where the longest dimension is no more than about 0.1 mm, or no more than 0.05 mm in size), where the iron ore concentrate has not undergone pelletization and/or induration. The iron ore concentrate that has not undergone pelletization and/or induration is present within the conveyor reduction furnace in a layer that is no more than about 5 cm, or no more than about 3 cm thick (e.g., 1-5 cm thick), the hydrogen gas or natural gas reducing the iron ore concentrate, so as to remove oxygen therefrom, and converting the iron ore concentrate material to a material having a composition similar to direct reduced iron (DRI) or sponge iron product, having about 90-95% iron by weight, up to about 10% oxygen by weight, optionally with other trace impurities (e.g., such as sulfur). As noted above, while iron ore concentrate may be processed as described herein, where the particles are no more than about 0.1 mm in size, it will be appreciated that larger sized particles e.g., upgraded mm-sized iron ore particles, e.g., having sizes up to 0.5 mm, or even up to 1 mm may be processed in a similar manner, e.g., by operating at the upper end of the temperature range, or even somewhat higher than 1000° C., at higher temperatures and longer residence times than for the smaller particle sizes or no more than 0.1 mm.

In an embodiment of the system or method, energy consumption is reduced by 30-50% compared with an average blast furnace, and/or $CO_2$ emissions are reduced by at least 60%, such as 60-95%, or even substantially 100%, depending on whether natural gas or hydrogen is used for reduction.

In an embodiment of the system or method, the moving bed conveyor reduction furnace is a countercurrent reactor, with flow of the hydrogen or natural gas flowing countercurrent to the movement of the iron ore concentrate.

In an embodiment of the system or method, the iron ore concentrate that has not undergone pelletization and/or induration is present within the conveyor reduction furnace in a layer that is no more than about 3 cm thick.

In an embodiment of the system or method, the iron ore concentrate that has not undergone pelletization and/or induration is present within the conveyor reduction furnace in a layer that is from about 1 cm to about 5 cm thick, or 1 to 3 cm thick (e.g., 1, 2, 3, 4, or 5 cm thick).

In an embodiment of the system or method, the reaction rate is predominantly controlled by interparticle diffusion rather than temperature. In an embodiment, the layer may be sufficiently thick (e.g., at least about 1 cm thick) to ensure interparticle diffusion control.

In an embodiment of the system or method, the furnace is operated at a temperature in a range of 500-1000° C.

In an embodiment of the system or method, the furnace is operated at a temperature in a range of 850-1000° C.

In an embodiment of the system or method, the furnace is operated at a temperature in a range of 850-950° C.

In an embodiment of the system or method, the iron ore concentrate is fed into the furnace on a moving grate and/or loaded on trays on a moving conveyor belt.

In an embodiment of the system or method, hydrogen gas is used as the reductant, the process producing no significant $CO_2$ emissions.

In an embodiment of the system or method, natural gas (predominantly methane) can be used as the reductant.

The reductant may include about 5%, 10%, 15%, 20%, 25%, 30%, 35%, 40%, 45%, 50%, 55%, 60%, 65%, 70%, 75%, 80%, 85%, 90%, or about 95% by weight or volume of hydrogen, or natural gas. A mixture of hydrogen and natural gas may be used, including any of such fractions of either component. Ranges between any such values may be used (e.g., 5%-95% hydrogen, or 5%-95% natural gas, etc. In an embodiment, the reductant gas flow may consist essentially of hydrogen and/or natural gas. An inert gas may be included, if desired.

In an embodiment of the system or method, stacks of multiple beds of the iron ore concentrate particles being reduced may be fed through the moving bed reactor simultaneously, e.g., in order to increase reduced product output. For example, such beds may be stacked within a horizontal reactor, with space between each stacked moving bed, to allow the hydrogen or other reductant gas to flow over each of the stacked beds. In an example including multiple stacked beds, 2 to about 10 stacked beds (each separate from the other, to allow gas flow thereover) may be provided within the reactor.

In an embodiment of the system or method, the loose iron ore concentrate particles may have an average size (e.g., largest dimension) that is less than 0.1 mm, less than 0.05 mm, such as from 5 μm to 0.1 mm, from 5 μm to 50 μm, or from 10 μm to 50 μm (e.g., 100 μm or less, or 50 μm or less, such as about 45 μm, or about 30-40 μm). Larger sized iron ore particles, e.g., having sizes up to 0.5 mm, or even 1 mm, may be processed in a similar manner as described herein, where the process operates at the higher end of the described temperature range, or even somewhat higher than 1000° C. At such increased temperatures at greater residence times, it may be possible to similarly convert such larger particle sizes in a similar manner as described herein.

In an embodiment of the system or method, reduction occurs at or near atmospheric pressure, rather than under any pressurized, or reduced pressure conditions. In another embodiment, the system or method may operate under pressurized conditions, e.g., up to 10 atmospheres. Such increased pressures would reduce the volume of the pressurized reductant gas, perhaps allowing for a smaller plant that would produce the same tonnage output, even once the additional complexity to accommodate pressurization is accounted for. The rate of reaction under such pressurized conditions would also be expected to proceed faster, providing an additional advantage to such a plant operating under pressurized conditions.

Features from any of the disclosed embodiments may be used in combination with one another, without limitation. This summary is provided to introduce a selection of concepts in a simplified form that are further described below in the detailed description. This summary is not necessarily intended to identify key or essential features of the claimed subject matter, nor is it intended to be used as an indication of the scope of the claimed subject matter.

Additional features and advantages of the disclosure will be set forth in the description which follows, and in part will be obvious from the description, or may be learned by the practice of the disclosure. The features and advantages of the disclosure may be realized and obtained by means of the components and combinations particularly pointed out in the appended claims. These and other features of the present disclosure will become more fully apparent from the following description and appended claims, or may be learned by the practice of the disclosure as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings.

FIGS. 9A-9D show the relationship between $k_{app}$ and ($p_{H2}$, $p_{H2O}$) for linear reaction order; $k_{app}$ (in $s^{-1}$) $p_{H2}$ and $p_{H2O}$ are in atm.

FIGS. 10A-10D show the relationship between $k_{app}$ and ($p_{H2}$, $p_{H2O}$) for reaction order of half; $k_{app}$ (in $s^{-1}$) $p_{H2}$ and $p_{H2O}$ are in atm.

FIGS. 15A-15C show plots of conversion (X) vs. $t/(r_p^2 D_{AC})$ for iron ore concentrate beds of different bed heights reacting with pure hydrogen (P=0.85 atm) at 650° C., 850° C., and 900° C.

FIG. 16 shows a comparison of experimental conversion-time relationships for reducing a 1.85 cm high flat bed of magnetite (iron ore concentrate) at 900° C. using pure hydrogen (P=0.85 atm) as compared to the calculated conversion-time when reaction controls the reduction rate.

FIGS. 17A-17D show conversion-time plots for experimental and fitted data from the two models for magnetite reduction by pure hydrogen (P=0.85 atm) under control of interparticle-diffusion at four temperatures.

FIGS. 18A-18D show plots of the normalized position of the reaction front(s) as a function of normalized time ($t/t_{X=1}$) based on the one-step and two-step models for the reduction of a flat-bed ($F_p$=1) of iron ore concentrate reacting with pure hydrogen ($p_{H2}$=0.85) at four temperatures.

FIGS. 19A-19B show schematics for hydrogen reduction of a flatbed ($F_p$=1) of iron ore concentrate particles when (19A) one-step interparticle diffusion control or (19B) mixed control. The shading of the particle indicate the overall conversion of the particle.

FIGS. 20A-20D show conversion-time plots for experimental and fitted results from the 'Rigorous model' for magnetite reduction by pure hydrogen (P=0.85 atm) under control of interparticle-diffusion at four temperatures.

DETAILED DESCRIPTION OF THE PREFERRED EMBODIMENTS

One aspect of the present invention is to develop a hydrogen ironmaking technology where magnetite concentrate particles are reduced in a moving-bed reactor. An advantage of using hematite over magnetite ore is that hematite transforms into magnetite during the early stage of reduction, and as a result of the corresponding transformation in the crystal structure, there is a volume expansion which results in cracks and pores, which increase the kinetics of reduction. As a result, magnetite reserves are largely untapped for ironmaking in major steel-producing countries like India, and even where magnetite is used, it is often oxidized to hematite during the sintering or pelletization steps. The reduction of iron oxide by gaseous reductant is a complex heterogeneous reaction and depends on the source and type of iron oxide, its particle size, the temperature range of reduction, and the type of gaseous reductant, among other factors. As a result, there is of course considerable variation in the kinetics of reduction of iron oxides by gaseous reductant reported in the literature.

The reduction rate of a loose assemblage comprised of fine particles is much different from typical pellets or larger ore particles because of the large difference in porosity and/or changes in morphology that result from pelletization. For fine magnetite particles with irregular shapes, there is a strong possibility of reaction occurring through the nucleation-growth process as seen from microscopic evidence. Although the rate of iron oxide reduction by hydrogen has been studied and some data reported in the literature, the typically reported rate equations are for either pellets or larger ore particles and could not be applied directly to the proposed ironmaking process. Furthermore, information on intrinsic particle reaction kinetics is required to be able to describe and analyze the reduction rate under a wide ranges of conditions in which the rate-controlling steps may vary. Since the reaction kinetics is dependent on the source and morphology of the iron oxide used, the reaction rates have to be experimentally studied using the iron ore concentrate intended to be used in the process and under anticipated operating conditions.

Thermodynamics of Iron Oxide Reduction

The predominant iron oxide ores that are used for ironmaking are hematite ($Fe_2O_3$) and magnetite ($Fe_3O_4$). The reduction of these oxides involves the formation of sub-oxides depending on the temperature of reduction (T), as illustrated by the iron oxygen (Fe—O) phase diagram presented in FIG. 1.

Figure 1:
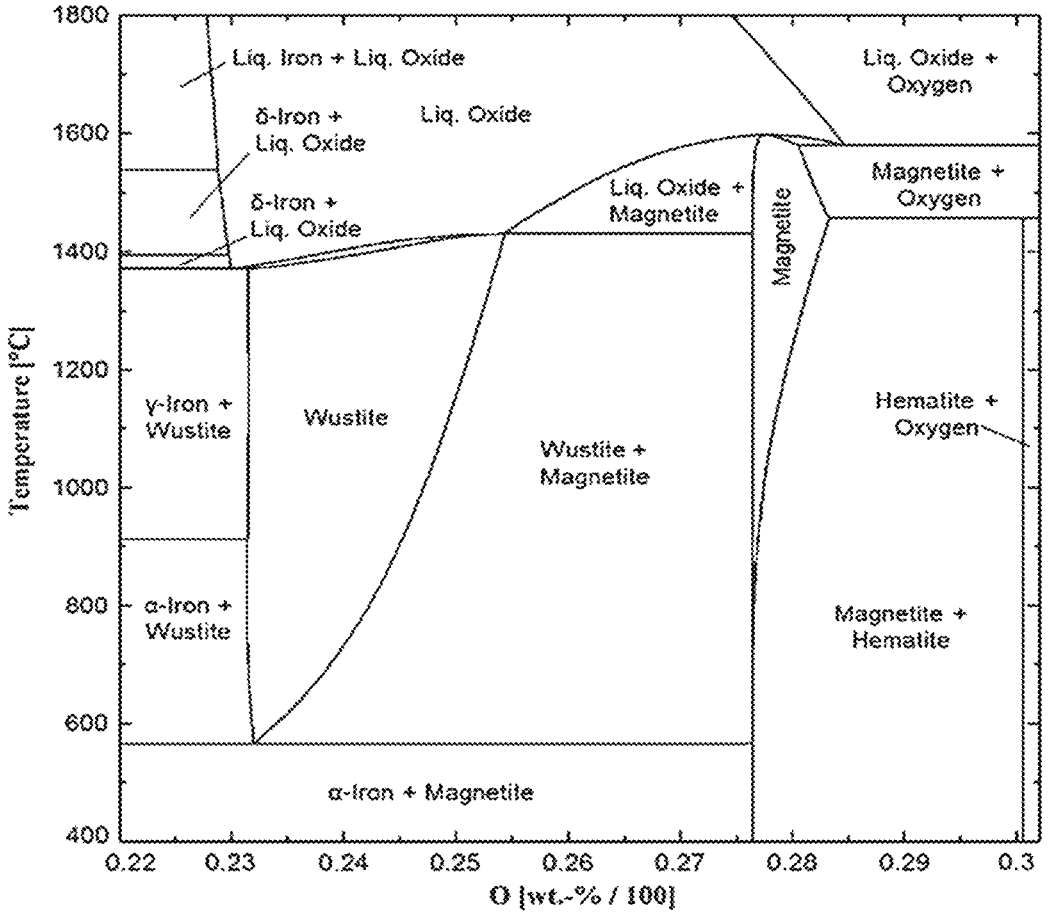
FIG. 1 shows a binary phase diagram of the iron-oxygen system.

As shown in FIG. 1, hematite ($Fe_2O_3$) is the form of iron oxide with the highest oxygen content. The reduction of hematite results in the formation of magnetite ($Fe_3O_4$) before it can be reduced to elemental iron. Below 570° C., magnetite directly reduces to iron. Above 570° C., the magnetite forms a non-stoichiometric oxide called wüstite, which is subsequently reduced to iron. Wüstite is non-stoichiometric iron oxide. This means that the stoichiometric iron oxide FeO spontaneously dissociates into Fe and $Fe_xO$ (where x is less than 1) even when there is saturation of iron. In terms of chemical composition, wüstite is intermediate between FeO and magnetite; however, it does not possess an intermediate structure and thus is not a solid solution. From FIG. 1, it can be seen that wüstite ($Fe_xO$) is stable over a range of bulk oxygen composition, and this region of stability grows with the increase in temperature. It has been reported that when $x<0.93$, there is a formation of magnetite exsolution lamellae. The overall composition is a result of a monoxide with an average composition of $Fe_{0.93}O$ and magnetite exsolution. In the temperature range of 576-910° C., wüstite with a composition between $0.93<x<0.96$ was reported to precipitate metallic iron. This indicates that the value of x in $Fe_xO$ is likely in the range of $0.93<x<0.96$ for the conditions encountered in the presently contemplated process.

When hydrogen is used as a reductant, the following steps are involved in the reduction of hematite:

$$3Fe_2O_3(s) + H_2(g) \rightarrow 2Fe_3O_4(s) + H_2O(g) \quad [2.1]$$

$$T < 570°C.$$

$$\frac{1}{4}Fe_3O_4(s) + H_2(g) \rightarrow \frac{3}{4}Fe(s) + H_2O(g) \quad [2.2]$$

$$T > 570°C.$$

$$\frac{x}{4x-3}Fe_3O_4(s) + H_2(g) \rightarrow \frac{3}{4x-3}Fe_xO(s) + H_2O(g) \quad [2.3]$$

$$Fe_xO(s) + H_2(g) \rightarrow xFe(s) + H_2O(g) \quad [2.4]$$

For the reactions given by Eqs. [2.1]-[2.4], the equilibrium condition is given as follows:

$$K = \exp\left(-\frac{\Delta G^0}{RT}\right) = \frac{p_{H_2O}}{p_{H_2}} \quad [2.5]$$

where K is the equilibrium constant, and $\Delta G^0$ is the standard Gibbs free energy for a given reaction occurring at a temperature T.

Equation [2.5] can be rearranged in the following form to describe the equilibrium conditions:

$$\frac{p_{H_2}}{p_{H_2} + p_{H_2O}} = \frac{1}{1+K} \quad [2.6]$$

The LHS of Eq. [2.6] described the 'reduction potential' of the reducing gas mixture where both hydrogen and water vapor are present. A plot of reduction potential ($p_{H_2}/(p_{H_2}+p_{H_2O})$) at equilibrium as a function of temperature superimposed on the iron-iron oxide stability region is called the Baur-Glaessner diagram for the iron-oxygen-hydrogen system and is presented in FIG. 2.

Thermodynamically, the reduction of hematite to magnetite by hydrogen, among the iron-oxide reduction reactions given by Eqs. [2.1]-[2.4], is the closest to being irreversible. Below 570° C., the equilibrium of the reduction of iron oxide to iron is limited by the reduction of magnetite to iron, which is described by Eq. [2.2]. Above 570° C., the reduction of wüstite to iron, given by Eq. [2.4], is the most thermodynamically limited step. As can be seen from FIG. 2, depending on the composition of wüstite ($Fe_xO$) there is a change in the region of stability of magnetite and wustite. However, the composition of wüstite has little effect on the reduction potential of the gas mixture, which is in equilibrium with wüstite and iron.

It is noted that the reduction of iron oxide by hydrogen is an endothermic reaction. The enthalpy change is 49.340 $kJmol^{-1}$ of Fe when magnetite is reduced to iron by hydrogen at 298 K, and the enthalpy change is 49.653 $kJmol^{-1}$ of Fe when hematite is used in place of magnetite.

Direct Use of Iron Concentrate Vs. Pelletization-Sintering-Induration

Traditionally, ironmaking is done in a blast furnace (BF) and steelmaking in a basic oxygen furnace (BOF). In a BF-BOF operation, and for many alternative ironmaking processes such as sponge ironmaking and MIDREX, the iron ore must be agglomerated into either a sinter or pellet before it can be used. This is because the feed for these processes needs to have sufficient strength to withstand impact and load above without significant breakage and simultaneously must be permeable to reducing gases such as hydrogen ($H_2$) and carbon monoxide (CO). A sinter is an agglomerate of iron ore fines (3-5 mm in size), coke breeze (~5 mm in size), fine limestone/dolomite (less than 3 mm), and sand, which is prepared by fusion of the materials together by combustion at a temperature of 1200-1300° C. The sintered product is broken up into 12-35 mm chunks. A pellet is made by the agglomeration of iron ore concentrates (~45 μm) with fluxes like limestone, lime, dolomite, and a binder like bentonite. An appropriate amount of water is added to the mixture of iron ore concentrate, fluxes, and binder, and pellet making is done in a rotating disc or drum where the capillary forces are responsible for agglomeration. The product obtained from this stage is called a green pellet (10-15 mm diameter), and it has to be first dried, and heat hardened (indurated) for it to gain sufficient strength due to diffusion bonding and, to some degree, due to recrystallization. Processes for sintering and pelletization will be apparent to those of skill in the art. Pelletization requires significantly more energy compared to sintering on a per ton basis. The electrical energy for sintering fines is 41.7 kWh/ton, while 101.5 kWh/ton is needed for pelletization. This is mainly because of a couple of reasons: iron ore used for pelletization is beneficiated to a greater degree, and oil is needed for making pellets. Riesbeck et al. reported the typical iron content for pellets to be 67% compared to an iron content of 61% for sinters. As the pellets have higher iron content, less of it is needed for producing a given amount of steel. For an integrated steel plant (BF-BOF process), using pellets only instead of a combination of sinter and pellets resulted in a decrease in the energy needed, and also less $CO_2$, $SO_2$, and $NO_x$ were generated.

The energy needed for pelletizing is dependent on the iron ore type. Magnetite ore requires 85% less fuel per ton of pellet compared to hematite ore, owing to the exothermic reaction taking place. The price of pellets depends on a variety of factors such as the cost of raw material, cost of fuel and electricity, and local inflation, among other things.

These agglomerating processes are performed at a high temperature and generate undesirable by-products. Additionally, there is a capital cost to build and operate an agglomeration process that increases the operation's overall cost. The agglomeration process consumes about 4% of total energy spent in producing liquid steel. The fraction of energy spent on agglomeration will be more significant in alternative processes where the overall energy expenditure is expected to be lower due to lower operating temperatures. Therefore, the direct use of iron ore concentrate without any agglomeration, as has been proposed in this work, will lead to a reduction of cost, and will cut down on the generation of undesirable by-products.

Rate Analysis for Iron Oxide Reduction

In general, during a fluid-solid reaction, there are several physical and chemical processes that occur. First, the reactant fluid is transported to the external surface solid aggregate by the bulk flow of fluid, which is a convective flow. Then, the reactive fluid is transported between the solid particles in the aggregate via inter-particle diffusion. Subsequently, in the cases where a porous product is formed, the fluid diffuses to the reaction front via pore-diffusion. The fluid participates in the chemical reaction occurring at the reaction front and forms both a solid and fluid as products. The product fluid first goes out of the particle via pore diffusion, then it moves to the surface of the aggregate via inter-particle diffusion, and from there it is carried away by the convective flow in the bulk fluid. The rates of convection and diffusion processes can be reasonably estimated, but the rate of chemical reaction occurring at the particle level cannot be predicted and must always be determined via experiments. These experiments are to be conducted so that the resistance due to external mass transfer, inter-particle diffusion, and pore diffusion on the reaction rate are much smaller than the chemical reaction of the particle. It is noted that the mechanisms of mass transport from inside the particles to the surrounding fluid are outside applicant's interest because it cannot be changed or controlled and thus not separately investigated. Hence, the rate of the combined chemical reaction and this transport within the particle, if significant, is termed as 'particle kinetics' henceforth.

The progress of the reaction was determined by measuring the mass of the sample over time during reaction in a thermogravimetric setup (TG). Based on the measurement of mass, a reaction achieves completion when the mass of a sample does not change with time while the reaction conditions are maintained. All the reduction reactions were carried to completion, and the mass of the sample was recorded using computer software at an interval of 1 second during the reduction. The degree of reduction or fractional conversion (X), as a function of reaction time (t), is calculated from the mass-time data as follows:

$$X(t) = \frac{m_0 - m_t}{m_0 - m_\infty} \quad [2.7]$$

where $m_0$ is the mass of sample at the start of reduction, $m_t$ is the mass of the sample after a reaction time of t, and $m_\infty$ is the mass of the sample after completion of reduction. The numerical value of conversion (X) is between 0 and 1. When no reaction has occurred X=0, and X=1 when the reaction is complete.

The rate of a fluid-solid reaction is expressed by the rate of change in fractional conversion with respect to time (dX/dt). In general, for an isothermal reaction, the reaction rate depends on various factors such as the temperature of reaction (T), partial pressures of the reactant and product gases (p), the particle size of the solid reactant ($d_p$), and the conversion of the solid (X). Mathematically, this can be expressed as follows:

$$\frac{dX}{dt} = k(T)h(p)q(d_p)f(X) \quad [2.8]$$

where k(T) is a function of temperature, h(p) is a function of gas partial pressures, $q(d_p)$ is a function of solid particle size, f(X) is the function of solid conversion.

Separation of variables in Eq. [2.8] results in the following form under constant temperature, partial pressures and particle size, which relates the reaction time (t) to the overall conversion (X):

$$g(X) = \int_0^X \frac{dX}{f(X)} = k_{app}t \quad [2.9]$$

where $$k_{app} = k(T)h(p)q(d_p) \quad [2.10]$$

The variable $k_{app}$ is termed as the apparent rate constant of the reaction. The value of the apparent rate constant ($k_{app}$) for a fluid-solid reaction depends on reaction conditions like temperature (T), gas partial pressures (p), and particle size ($d_p$).

The mathematical relationship that relates the conversion (X) and reaction time (t) for an isothermal reaction occurring under particle kinetics is called the conversion-function (g(X)). The experimentally obtained conversion-time data (X vs. t) was used to develop the rate equation that describes the particle kinetics to reduce iron-ore concentration by hydrogen. The conversion function, g(X), is chosen such that the g(X) vs. t plot constructed from the experimental data (X–t) results in the best straight line over the entire ranges of reaction conditions of interest.

In these experiments, the effect of external mass transfer was eliminated by increasing the flow of the reductant gas until the conversion-time relationship was unaffected by a further increase in the gas flow rate. A sufficiently shallow layer of iron oxide was used for experiments to minimize the contribution of inter-particle diffusion by decreasing the diffusion path. However, it is rather difficult to completely eliminate any effect of inter-particle diffusion on the reaction rate experimentally as the particle kinetics for this system is quite high. Therefore, a mathematical approach developed by Sohn and coworkers was used to eliminate any effect of inter-particle diffusion on the measured value of the apparent rate constant. Sohn and coworkers have demonstrated that for reactions where there is a small but finite effect of inter-particle diffusion, the conversion function (g(X)) is dependent on the characteristic diffusion size, $R_p$, of the solid aggregate as follows:

$$g(X)=(1-\chi R_p^2)k_{app}t \quad [2.11]$$

where $\chi$ is a constant that depends on reaction parameters like rate constant ($k_{app}$), the shape of particle assembly, shape of the particle, the effective diffusivity of the reductant gas, and the equilibrium constant for the chemical reaction. For a layer of particles, the size ($R_p$) is equal to the thickness of the layer. As all the experiments were carried out with iron-ore concentrate layers having the same cross-sectional area, the thickness of the layer ($R_p$) is directly proportional to the mass of the layer. Therefore, Eq. [2.11] can be rewritten in terms of the mass of the sample (m) as follows:

$$g(X)=(1-\lambda m^2)k_{app}t \quad [2.12]$$

where $\lambda$, is a constant for a given set of experimental conditions.

From Eq. [2.12], the slope of the conversion function (S) can be represented by the following:

$$S \equiv \frac{d}{dt}g(X) = (1-\lambda m^2)k_{app} \quad [2.13]$$

Figure 3:
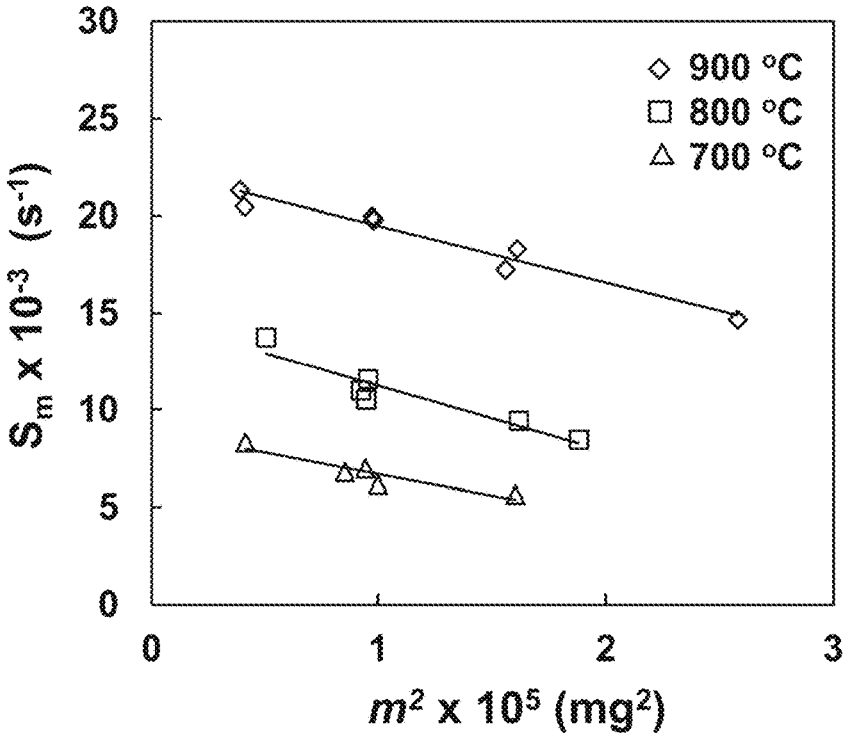
FIG. 3 shows a plot of the slope of conversion function (S) vs. $m^2$ at three different temperatures and $p_{H2}$=0.85 atm.

Experiments were performed using at least three different sample masses under otherwise identical experimental conditions (reduction temperature and partial pressure). The mass of the sample selected was such that it was small enough to minimize the effect of interstitial diffusion control while it was large enough to obtain a stable mass vs. time data for the reduction process. Applying Eq. [2.13], the value of the apparent rate constant ($k_{app}$) for the particle kinetics, under given reaction conditions, was estimated by extrapolating from the plot of S vs. $m^2$ to $m^2=0$. FIG. 3 is a plot of S vs. $m^2$ obtained at different temperatures for the reduction of iron-ore concentrate by pure hydrogen. The atmospheric pressure in Salt Lake City (where the experiments were conducted) is 0.85 atm.

In the case when there is no effect of inter-particle diffusion in the slopes, S should be unchanged with the change in sample mass. A good correlation was observed at all temperature and partial pressure combinations. The extrapolated values of slope (S) at m=0 was used to calculate the apparent rate constant ($k_{app}$) under different temperature and partial pressure combinations. These results were used to develop the rate equation, as will be discussed hereafter.

Concluding Remarks

The following comments summarize the discussion in this section:

1. Iron ore reduction by hydrogen has been studied extensively. The reported results depended on the reduction conditions like temperature, reducing gas composition and on the nature of the solid itself like particle size, the type and morphology of iron oxide. As a consequence, the rate information for a particular process has to be obtained experimentally.
2. Hematite reduction by hydrogen results in the formation of magnetite. The product from the magnetite reaction with hydrogen is dependent on the reduction temperature. At temperatures below 570° C., magnetite reduces directly to iron. This is also the thermodynamically limiting step under these conditions. Above 570° C., magnetite first reduces to wüstite and then the wüstite reduces to iron. In this case, the reduction of wüstite to iron by hydrogen is the thermodynamically limiting step. For the purpose of thermodynamic calculations in most practical cases, wüstite can be assumed to be FeO.
3. The direct use of iron ore concentrate in an alternative ironmaking process is advantageous as it results in the reduction of cost and also cuts down on the generation of undesirable by products such as $CO_2$, $SO_2$, and $NO_x$.
4. It may be difficult to experimentally eliminate the effect of inter-particle diffusion in a reduction reaction occurring in a thermogravimetric (TG) setup. However, the value of rate constant ($k_{app}$) in the absence of diffusional effects may be obtained from the slopes of the conversion functions for reactions where the effect of inter-particle diffusion is small.

Particle Kinetics of Iron Ore Concentrate Reduction

Figure 2:
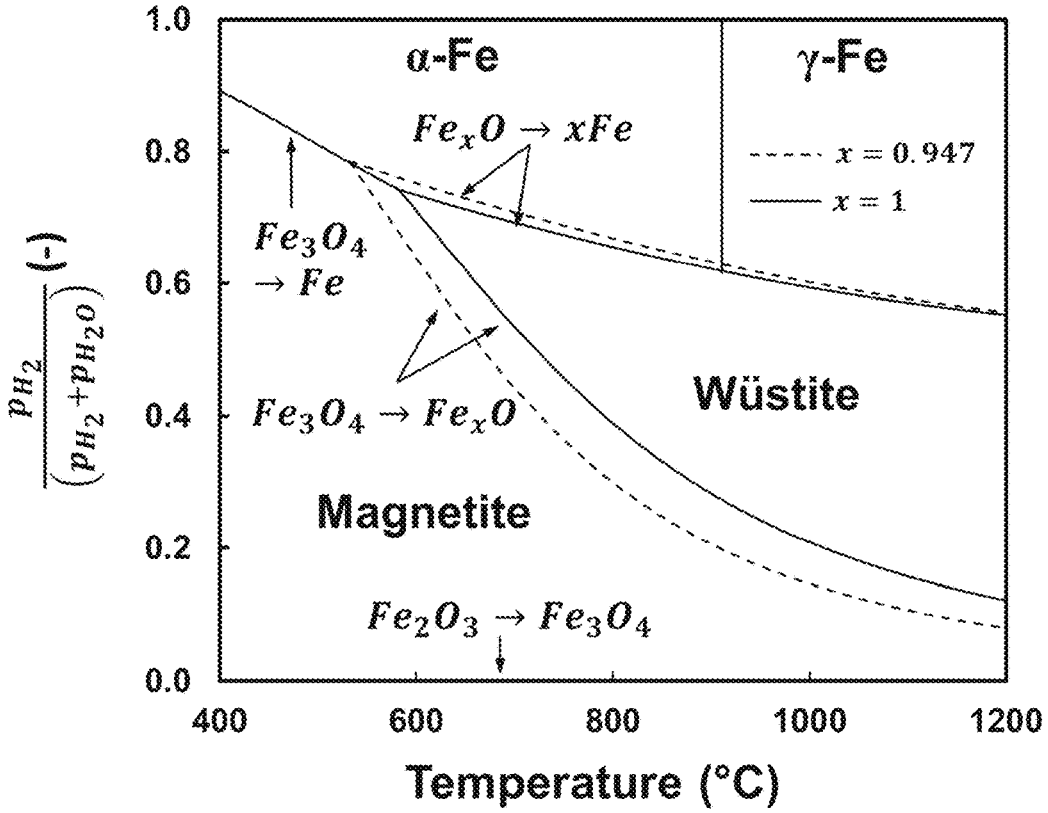
FIG. 2 shows equilibrium of the iron-oxygen-hydrogen system, constructed from data obtained from HSC Chemistry Version 9.9.

To design the proposed ironmaking process, it is important to determine the kinetics of reduction of iron-ore concentrate bed in a hydrogen atmosphere. The rate of reduction can be increased by increasing the temperature until the reaction is controlled by interparticle diffusion. In Flash Ironmaking Technology (FIT), the concentrate particles and the reducing gas mixture are fed into the reactor in a co-current manner. This means that in a reactor that operates with the minimum amount of reducing gas, the gas mixture is in equilibrium with iron-wüstite at the solid discharge outlet. This is not the case in a moving bed ironmaking reactor as described herein as the gas and the solid move in a counter current fashion. In a reactor operating with the minimum amount of reducing gas the gas is in equilibrium with hematite-wüstite or magnetite-wüstite system, depending on the kind of iron ore in use. In the context of hydrogen ironmaking, the hydrogen equilibrium partial pressure for hematite-wüstite or magnetite-wüstite equilibrium is quite low over the proposed operating temperature. While in the case of iron-wüstite the partial pressure of hydrogen has a value much greater in the same temperature range as shown in FIG. 2. This means the utilization of the chemical potential of hydrogen is higher in a moving bed reactor compared to a FIT reactor.

In a bed of iron ore concentrate, the fastest possible reaction rate is achieved by increasing temperature so that the reduction occurs under interparticle diffusion control. Under such a condition, the rate does not increase significantly with an increase in reduction temperature, because mass transfer is only a weak function of temperature.

The aim of investigating the particle kinetics is to obtain the minimum temperature at which interparticle diffusion largely controls the rate of reduction for a given depth of concentrate bed. The kinetics of iron oxide reduction by hydrogen has been studied. The reaction kinetics was found to be highly specific to the nature of the particles used. This means that chemically identical iron oxides, which were from different sources, had different rates of reduction under otherwise identical reduction conditions. The difference in the rate of the reaction was due to the difference in structure and morphology.

The rate equation for the particle kinetics is also dependent on the reduction conditions, like temperature, particle size, and partial pressure of reducing gas, among other things. Therefore, the particle kinetics of the iron ore concentrate at higher temperature ranges obtained by Elzohiery et al. and Fan et al. were not extrapolated. The particle kinetics of iron ore concentrate under the desired operating conditions as contemplated herein was not available in the literature. Therefore, this information was obtained by experiments carried out under the range of conditions in which the proposed ironmaking process is envisioned. The particle kinetics developed in this work was compared to the extrapolated particle kinetics developed for FIT. It was found that a direct extrapolation of the latter did not yield a satisfactory representation of the kinetics measured in the much lower temperature range for the presently proposed process.

Material Preparation

Figure 4:
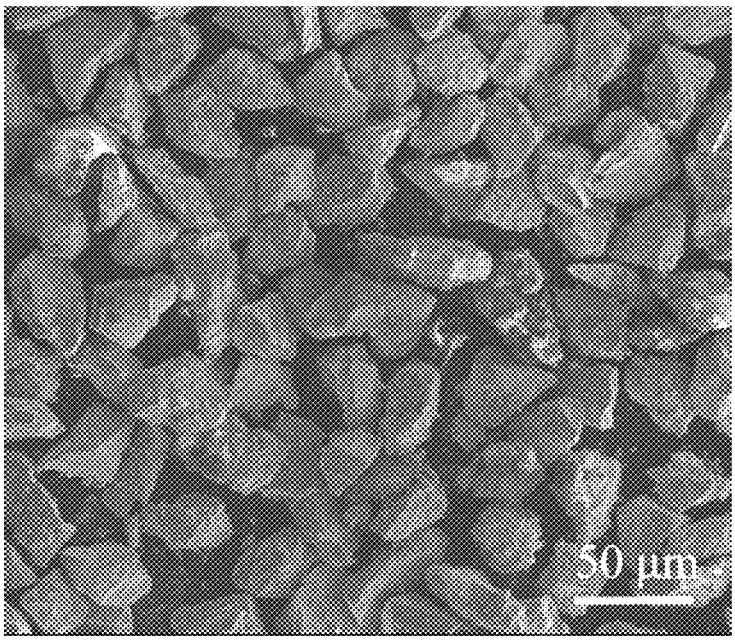
FIG. 4 shows an SEM micrograph of exemplary iron ore concentrate particles used for the experiments described herein.

The iron ore concentrate used in these experiments was obtained from taconite deposits of the Mesabi Range, USA. The iron ore concentrate had a particle size below 100 μm. The mass average particle size was 32.5 μm, and the total iron content was between 65 to 70%. Cho and Sohn demonstrated that the kinetics of an assemblage could be represented by the kinetics of particles with the mass average size, regardless of whether the reaction is controlled by chemical reaction or diffusion. For particles with a very small size, the handling becomes problematic. It is difficult to pick a representative sample for particles with large sizes. In addition, the larger particles contained more gangue material. The bulk of this concentrate particles have sizes in the range of 20-53 μm, and this size fraction was also narrow enough to represent the mass average particle size of the particles. Therefore, particles within the size fraction of 20-53 μm were separated by wet screening and were used for the experiments described herein. An SEM micrograph of a sample of the sieved concentrate particles is presented in FIG. 4, and it shows that most particles are within the specified size range and individual particles have an irregular shape. Depending on the experiment, a combination of hydrogen and nitrogen gas was used as the reductant, and both the individual gases used in this work had a purity of 99.99%.

Experimental Setup

Figure 5:
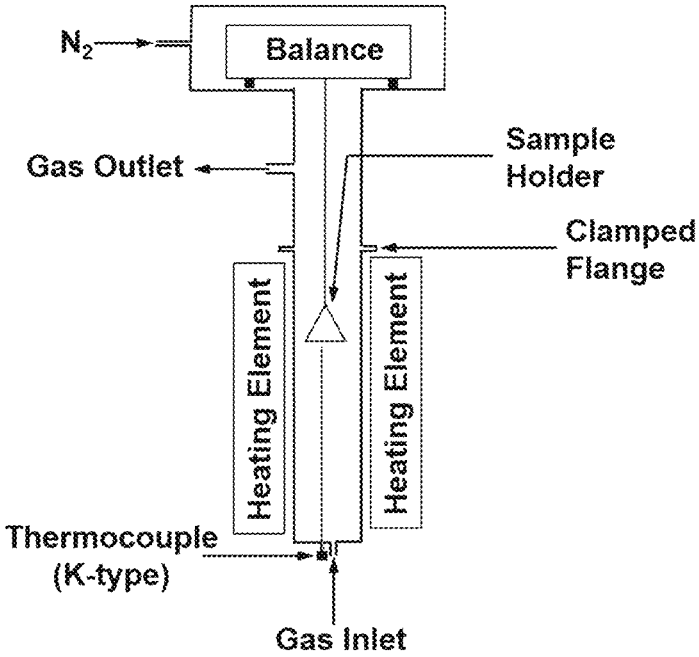
FIG. 5 shows a schematic of the employed thermogravimetric (TG) setup employed herein.

The progress of the reduction reaction was followed by measuring the changes in the mass of a sample undergoing reduction as a function of time. It was assumed that the weight loss was due to the loss of removable oxygen from the iron ore sample. Previously, a drop tube reactor (DTR) was used for determining particle kinetics for the reaction conditions in FIT, as in such a reactor, it is relatively easy to eliminate the effects of external mass transfer, pore-diffusion, and interparticle diffusion. Unlike in the case of FIT, in this proposed process, the objective is to reduce a bed of iron ore concentrate by a stream of hydrogen. As a result, the setup in this work was used for determining both the particle kinetics and the kinetics under the control of interparticle diffusion. More importantly, as the temperature of reduction is lower compared to FIT, the rate of reaction is expected to be slow enough to be measured conveniently using a thermogravimetric (TG) setup. Therefore, a TG setup was used for measuring the weight of concentrate particles undergoing reduction. The setup consisted of a vertical tubular furnace with a stainless-steel tube (6.7 cm ID, 91.4 cm long), an electronic balance (Ohaus Balance Adventurer model AX223/E, sensitivity 1 mg) connected to a suspended sample holder (a flat disc of 4.4 cm OD) located at the center of the furnace, gas delivery lines connected to gas flow regulators, and an off-gas outlet. A K-type thermocouple was placed just below the sample holder and was used for determining the temperature during the reaction. A schematic for the experimental setup is presented in FIG. 5.

A small amount of iron-ore concentrate particles was placed on the sample holder, and the furnace was closed, following which nitrogen was flowed into the furnace tube to purge all the air from inside the reactor before heating up. The sample mass was between 190-510 mg and the flow rate of hydrogen was 3600 ml/min or greater for all the experiments. The reactor was heated up to the target temperature under a flow of nitrogen. The temperature measurement from the thermocouple was monitored constantly during the experiment to ensure that the temperature was maintained at T±5° C. throughout the reaction. Once the target temperature was reached, the nitrogen was replaced by a reducing gas mixture specific to the experiment. The reducing gas mixture was flowed in at a rate sufficiently high to overcome the resistance due to external mass transfer, i.e., mass transfer between the bulk gas and the particle surface. The gas flow to the reactor was regulated by rotameters and the hydrogen partial pressure was adjusted by the addition of nitrogen. Throughout the experiment, the mass of the sample was recorded continuously at an interval of 1 s by using a computer connected to the balance that had a precision of 1 mg. The balance was placed in a chamber directly above the furnace. An inert atmosphere was maintained inside the balance chamber by continuously passing nitrogen at room temperature through it. This flow of nitrogen also kept the temperature inside the balance chamber from rising during the experiment. After the completion of a run, the flow of gas was switched from the reducing gas to nitrogen and the sample was collected after the reactor was cooled down to room temperature under nitrogen flow.

Results

Figure 6A:
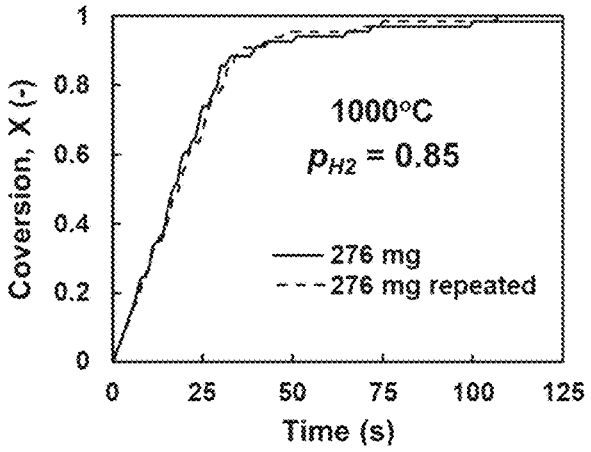
FIGS. 6A-6B shows conversion-time relationships from repeated experiments at two different temperatures.
Figure 6B:
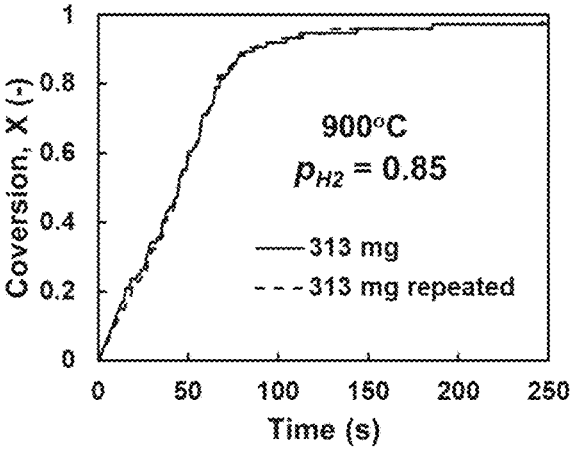

To measure the particle kinetics, i.e., the rate of reduction of individual particles without the effect of mass transfer, it was necessary to conduct the experiments under the conditions in which the primary resistance to the progress of reduction is the reaction between hydrogen and the individual particles. This was achieved by placing a shallow layer of iron ore concentrate on the sample holder and flowing the reduction gas mixture at a high flow rate. The gas flow rate was set at a value such that the resistance due to the external mass transfer of hydrogen through the gas boundary layer was negligible. The effect of interparticle-diffusion of hydrogen through the bed was also eliminated as described herein. Further, from the results discussed in subsequent sections, it can be demonstrated that if the rate measured in this setup was controlled by either external mass transfer or interparticle-diffusion, the time for complete reduction was expected to be on the order of milliseconds. The experimentally measured time for complete reduction was on the order of several minutes for the entire range of operating conditions used in this investigation. Therefore, under these experimental conditions, the reaction was predominantly controlled by the chemical reaction of individual particles with hydrogen. The apparent rate constant at a certain temperature and partial pressure combination was calculated based on several experiments as has been described herein. The reproducibility of the experimental measurements was also verified by repeating some experiments. Good agreement was observed in all those cases. FIGS. 6A-6B show a comparison of conversion-time data obtained from the repeated experiments at two different temperatures.

Figure 7A:
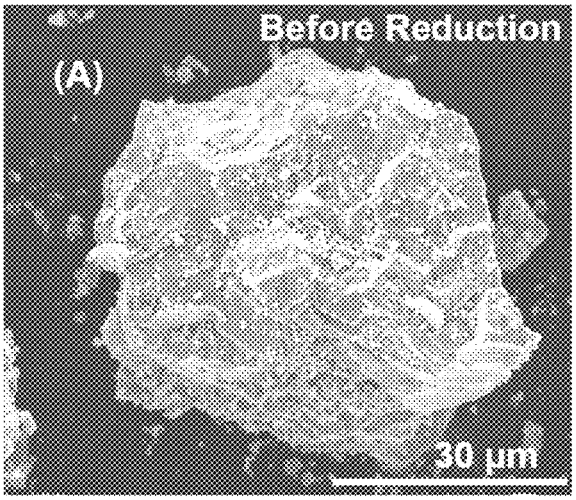
FIGS. 7A-7B show SEM micrographs of (7A) an iron-ore concentrate particle before reduction, and (7B) a particle of completely reduced iron-ore concentrate, which was reduced at 1000° C. under a flow of pure hydrogen ($p_{H2}$=0.85 atm).
Figure 7B:
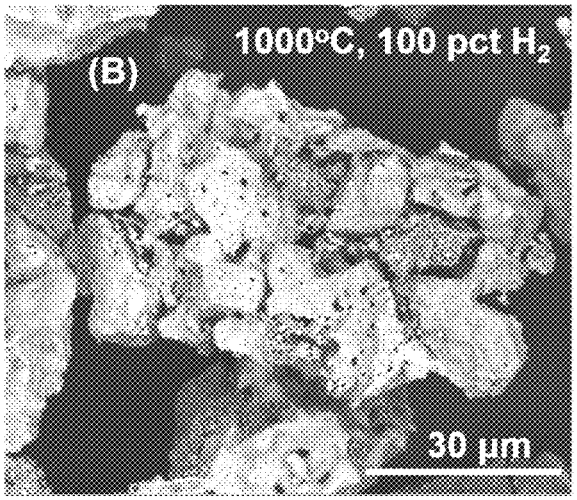

For the experimental conditions under which the particles kinetics were obtained, no evidence of sintering or agglomeration of particles was observed in the reduced particles. This is apparent from FIGS. 7A-7B, which presents micrographs of the unreduced particles and particles reduced at 1000° C. As a higher temperature of reduction favors sintering or agglomeration, it is not likely that there is sintering at lower temperatures.

Selection of Rate Equation

In general, the equation describing the particle kinetics is a function of reduction temperature, hydrogen partial pressure, degree of conversion, particle size, and the source of iron ore concentrate. Analysis of the experimentally obtained conversion-time data showed that the overall reduction was best described by nucleation and growth kinetics. This observation was consistent with the SEM micrograph of reduced product that shows iron nuclei formation, as observed in FIGS. 7A-7B. The size fraction of the particles chosen for this work is a narrow size range around the mass average particle size. The rate obtained based on the mass average size is representative of the overall rate of reaction irrespective of the rate-controlling process. Therefore, the particle size dependence on the rate-equation was not investigated in this work.

The reduction rate investigated in this work is the overall or global rate of reduction. This is because the resultant rate-equation from this investigation describes the conversion-time relationship for the overall reduction, i.e., iron ore concentrate reducing to iron and does not consider the formation of intermediate oxides, such as wüstite ($FeO_x$) in the case of magnetite reduction, that can form in the temperature range under investigation. The measurement of the kinetics of an intermediate oxide is especially difficult and not meaningful for this case as different areas of small irregular iron oxide particles react at different rates, resulting in differences in the local conversion within individual particles as well as in the formation of different phases. This means multiple oxides can coexist inside a particle during the reduction, depending on the conditions.

As the main objective of this work is to design an alternative ironmaking process, the global kinetics of the reduction reaction is investigated in this work that provides information on the overall extent of oxygen removal. The degree of reduction was defined by overall conversion (X), which is the ratio of measured weight loss of sample due to oxygen removed at an instant to the total removable oxygen in the sample, which was determined by measuring the mass of the sample after reducing the starting material for a long time.

The expression for the nucleation and growth kinetics containing the process variables is given as follows:

$$[-\mathrm{Ln}(1-X)]^{1/n}=k_{app}\times t \quad [3.1]$$

$$k_{app}=k\times f(p_{H_2},p_{H_2O}) \quad [3.2]$$

$$[-\mathrm{Ln}(1-X)]^{1/n}=k\times f(p_{H_2},p_{H_2O})\times t \quad [3\ 31]$$

In Eqs [3.1]-[3.3], n is the Avrami parameter, $k_{app}$ is the apparent rate-constant, k is the rate-constant, $f(p_{H_2}, p_{H_2O})$ is the dependence on gas partial pressures, and t is the time for reaction. The derivation of the Avrami equation for nucleation and growth equation can be found in an article by De Bruijn et al.

Figure 8:
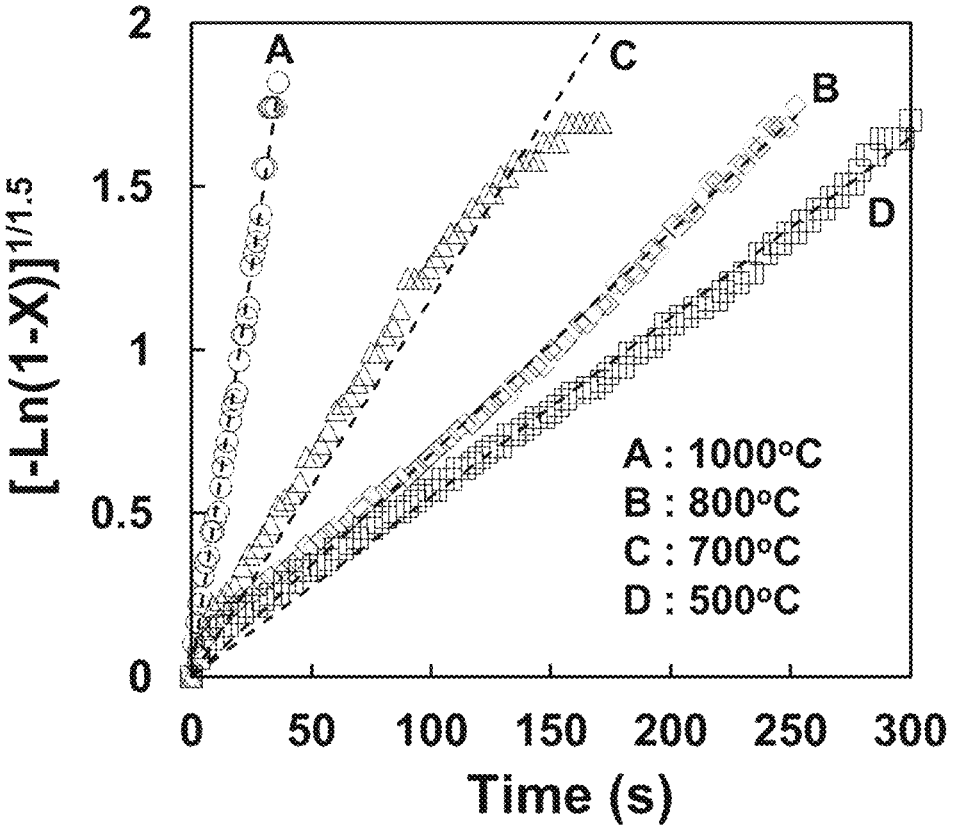
FIG. 8 shows the experimental conversion-time data fitted to nucleation and growth rate equation, n=1.5, at four different temperatures with pure hydrogen ($p_{H2}$=0.85 atm).

In Eq [3.1], the Avrami parameter (n) can typically have a value between 1 and 4. It was observed that when the value of the Avrami parameter (n) was 1.5, Eq. [3.1] accurately describes the experimental conversion-time data up to a high degree of conversion over the entire range of conditions. FIG. 8 shows an example of experimentally obtained conversion-time data fitted to a nucleation and growth rate equation with n=1.5. An alternative method for determining the reaction order is by the rearrangement of Eq. [3.1] as follows:

$$\mathrm{Ln}(-\mathrm{Ln}(1-X))=n\ \mathrm{Ln}\ t+n\ \mathrm{Ln}\ k_{app}|_0 \quad [3.4]$$

For a given reduction temperature and partial pressures of hydrogen and water vapor, the apparent rate constant has a fixed numerical value. Thus, the second term on the right-hand side of Eq. [3.4] is a constant and is equal to the y-intercept on the plot of Ln(−Ln(1−X)) vs. Ln t, where X and t are the experimental conversion-time (X−t) data under the particular reaction condition. The Avrami parameter (n) is the slope of the line on the Ln(−Ln(1−X)) vs. Ln t plot. The use of this method leads to the best fit value of Avrami parameter (n) for every experimentally obtained conversion time data. However, the best fit value doesn't conform to a well-established nucleation and growth mechanism, whereas the value of n=1.5 corresponds to one-dimensional nucleation in solids where the growth is diffusion-limited. Therefore, the experimental conversion-time data was force-fitted into the nucleation and growth rate-equation with n=1.5 to obtain rate constants, partial pressure dependence, and activation energy.

The rate dependence on conversion (X) is termed as the conversion function, and for particle kinetics, the conversion function is denoted as g(X) and is given as follows:

$$g(X)=k_{app}\times t \quad [3.5]$$

The reaction rate slows down drastically as the reaction approaches completion. This results in a conversion-time relationship with a long tail. Theoretically, complete conversion is achieved after infinite time, as can be verified from equation [3.1]. Therefore, the applicability of equation [3.1] to the experimental data was verified up to an overall conversion (X) of 0.9.

Determination of Reaction Order

All the experiments in this investigation were conducted in Salt Lake City, Utah, where the barometric pressure averages 0.85 atm (1 atm=101.32 kPa), and this was taken into consideration when analyzing the data. To determine the rate dependence on gas partial pressures, the apparent rate constant ($k_{app}$, in $s^{-1}$) at a specified temperature was calculated from the slope of the fitted conversion function (g(X)) vs. time (t) plot. If the slope of the g(X) vs. t plot is denoted as S, its relationship to the reaction order is as follows:

$$S=k\times f(p_{H_2},p_{H_2O}) \quad [3.6]$$

The overall reduction of iron ore concentrate involves the reduction of wüstite as a sub-step, and that is an equilibrium-limited reaction. As the overall rate-equation should be valid for all conditions, including at equilibrium, the function representing the partial pressure dependence for iron oxide reduction should have equal exponents for partial pressure of both the reactant and product gases, and can be expressed as follows:

$$f(p_{H_2}, p_{H_2O}) = p_{H_2}^m - \left(\frac{p_{H_2O}}{K}\right)^m \quad [3.7]$$

where m is the reaction order with respect to the partial pressure of hydrogen, and K is the equilibrium constant for wüstite reduction by hydrogen at that temperature.

In the experiments that are being discussed, the water vapor generated in the process of the reduction is immediately removed by the continuous flow of gas, and new reactant gas is brought to replace it as the resistance to external mass transfer, and interparticle-diffusion is negligible. Therefore, during the analysis of these experiments, the second term on the RHS in Eq. [3.7] was neglected. The partial pressure of hydrogen was varied by varying the amount of nitrogen in the reduction gas mixture such that the overall gas flow rate was the same for all experiments. Ideally, it would be appropriate to also test the effects of water vapor. However, it is difficult to accurately measure the rate of flow of water vapor, as there is always a possibility of condensation involved in the process. Previous results indicated that the effect of water vapor can largely be accounted for by the expression given by Eq. [3.7].

In the case of a metal-hydrogen system, typically, the reaction is either half order or first order. It was observed from FIGS. 9A-9D that apparent rate-constant, $k_{app}$ (in $s^{-1}$), for the reduction of iron-ore concentrate has a linear dependence on partial pressures of hydrogen over the entire range of conditions being investigated. The test of half-order dependence presented in FIGS. 10A-10D is seen to give much poorer fits. This result is also consistent with the partial pressure dependence of iron-ore concentrate reduction by hydrogen at higher temperatures.

Determination of Activation Energy

The apparent rate-constant ($k_{app}$, in $s^{-1}$), obtained from the nucleation and growth conversion function with n=1.5, is a function of temperature. As it was established that the apparent rate constant has a first-order dependence on the partial pressure of hydrogen gas (m=1), temperature-dependent part of the apparent rate-constant can be isolated in the following way:

$$k = \frac{k_{app}}{f(p_{H_2}, p_{H_2O})} = \frac{k_{app}}{p_{H_2} - p_{H_2O}/K} \quad [3.8]$$

where k is the rate-constant ($s^{-1}atm^{-1}$) for the reduction reaction and $p_{H_2O}$ is 0 in this work. Temperature dependence of the rate constant is commonly described by the Arrhenius equation, which is given as follows:

$$k = k_0 \times \exp\left(-\frac{E}{RT}\right) \quad [3.9]$$

where $k_0$ is the pre-exponential factor (in $s^{-1}atm^{-1}$ in this case), E is activation energy (in $kJmol^{-1}$) for the reaction, R is the universal gas-constant (8.314 $kJmol^{-1}K^{-1}$), and T is the absolute temperature (in K).

By taking the natural logarithm of Eq. [3.9], the following relationship is obtained:

$$\mathrm{Ln}k = \mathrm{Ln}k_0 - \frac{E}{R} \cdot \frac{1}{T} \quad [3.10]$$

Using Eq. [3.10], the activation energy and the pre-exponential factor were calculated. The slope of the Arrhenius plot, i.e., the plot of Ln k vs. (1/T), was determined from the equations of best-fit lines obtained by using Microsoft Excel. The slope was used for calculating the activation energy (E, in $kJmol^{-1}K^{-1}$) while the pre-exponential factor ($k_0$, in $s^{-1}atm^{-1}$) was calculated from the y-intercept of the best fit line as shown in FIG. 11.

Figure 11:
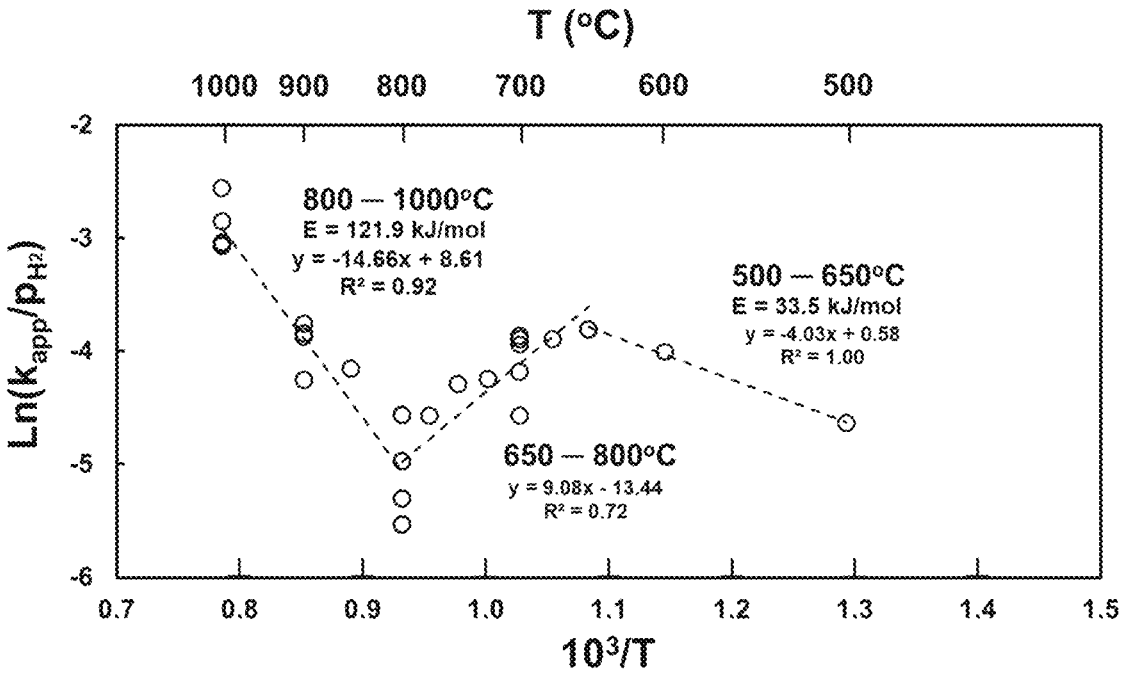
FIG. 11 shows an Arrhenius plot for obtaining activation energy (E, in $kJmol^{-1}K^{-1}$) and pre-exponential factor ($k_0$, in $s^{-1}atm^{-1}$). [$k_{app}$ (in $s^{-1}$), $p_{H2}$ (in atm)].

It was observed from FIG. 11 that the rate of the reaction decreased with an increase in temperature between 650-800° C., which is unusual. A similar slowing down of the reaction was observed for the hydrogen reduction of iron oxides in previous studies. Multiple factors have been suggested for this phenomenon, such as imperfections in the crystal lattice, the presence of impurities, and the sintering of reaction products. The rate of gas-solid reactions could also increase or decrease as solids undergo first or second-order transitions in an effect called Hedvall effect.

The activation energy for the reaction was calculated over two temperature ranges: 500-650° C., and 800-1000° C. The activation energy was found to be 33.5 $kJmol^{-1}$ between 500-650° C., and 125.1 $kJmol^{-1}$ between 800-1000° C. The equation for rate constant (k) as a function of temperature between 650-800° C. is given below. The activation energy for a given fluid-solid reaction depends on a variety of factors such as the presence of the impurity, the morphology of the solid, and even on the conversion function used to describe the conversion-time data. Therefore, a direct comparison with other values from the literature is not very meaningful. The activation energies for a reaction was found to depend on the nature of the reactant used and temperature range over which the kinetics was investigated. The activation energy for the overall reduction of magnetite to iron increased with increase in reduction temperatures. At temperatures around 800° C. and above the activation energies in the order of 100 $kJmol^{-1}$ was reported while between 550-600° C. the reported activation energies were around 60 $kJmol^{-1}$. These values are comparable to the values obtained in this work.

Activation energy is defined in the case when the rate of the reaction increased with an increase in temperature. In the temperature range where a slowing down of reaction was observed, temperature dependence can still be evaluated from the Arrhenius plot, but in this case, the definition of the rate constant is as follows:

$$k = k_0 \times \exp\left(\frac{A}{T}\right) \quad [3.11]$$

where A is a constant (in K) obtained from fitting Eq. [3.11] to the Arrhenius plot over 650-800° C. In this case value of $k_0$ is $2.25\times10^{-5}$ $s^{-1}atm^{-1}$ and A is 6430 K.

This approach was selected to use a common form of the rate equation as a function of reduction temperature and hydrogen partial pressure over the entire range of operating conditions investigated in this work.

Validation of the Rate Equation

The rate equation for the overall reduction of iron-ore concentrate with hydrogen gas is given separately for different temperature ranges.

Between 800-1000° C., the rate-equation is:

$$[-\mathrm{Ln}(1 - X)]^{1/1.5} = \quad [3.12]$$

-continued $$9.99\times10^{3}\times\exp\left(-\frac{125{,}100}{RT}\right)\times\left(p_{H_2}-p_{H_2O}/K\right)\times t$$

Between 650-800° C., the rate-equation is:

$$[-\mathrm{Ln}(1-X)]^{1/1.5}=2.25\times10^{-5}\times\exp\left(-\frac{6430}{T}\right)\times\left(p_{H_2}-p_{H_2O}/K\right)\times t \quad [3.13]$$

Between 500-650° C., the rate-equation is:

$$[-\mathrm{Ln}(1-X)]^{1/1.5}=1.79\times\exp\left(-\frac{33{,}500}{RT}\right)\times\left(p_{H_2}-p_{H_2O}/K\right)\times t \quad [3.14]$$

where R is 8.314 $\mathrm{Jmol^{-1}K^{-1}}$, T is in K, p is in atm, and t is in seconds.

The product iron from the ironmaking process is an intermediate industrial product. The iron is used to make steel, and therefore the iron only needs to have a conversion of about 90% (X=0.9) or greater. Therefore, from the industrial point of view the time for achieving 90% conversion is an important parameter. The validity of the developed rate-equations was verified by comparing the experimental value of time for % conversion to the values calculated from the rate equation over the entire range of conditions investigated in this work.

Figure 12:
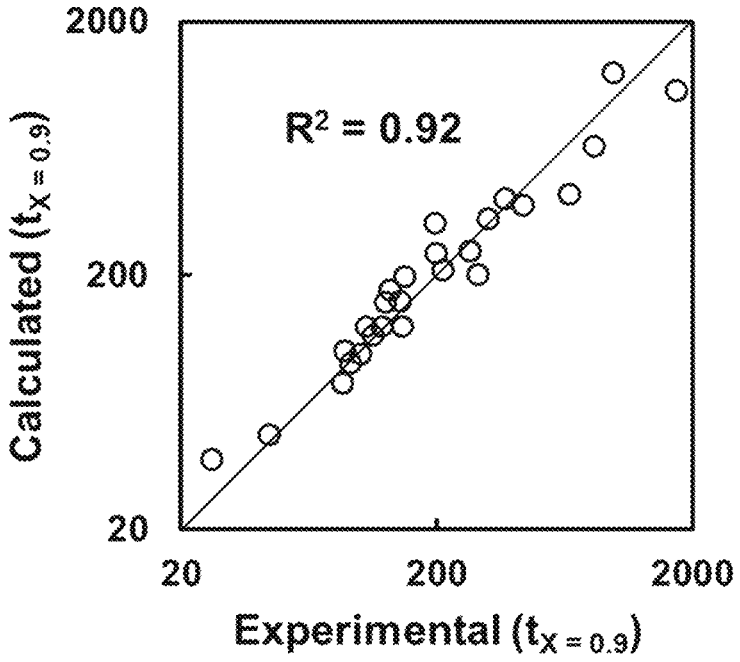
FIG. 12 shows a comparison of the time for 90% conversion (X=0.9) obtained from the developed rate-equations as compared to experimentally obtained values for the reduction of iron ore concentrate with hydrogen at all the temperatures and partial pressure conditions investigated. Time (t) is both measured and calculated in seconds.

A plot comparing the calculated and experimental time of conversion is presented in FIG. 12. Good agreement was obtained over the entire range of temperatures and partial pressures. This establishes the validity of the developed rate equations.

Concluding Remarks

From the investigation of particle kinetics for iron ore concentrate reduction by hydrogen, the following can be summarized:

1. The global rate of reduction of iron ore concentrate in hydrogen was developed over the temperature range of 500-1000° C.
2. A nucleation and growth equation with an Avrami-parameter (n) of 1.5 best described the experimental conversion-time data over the entire range of conditions investigated. SEM micrographs of the reduced product supported the nucleation and growth mechanism.
3. The rate of reduction had a first-order dependence on the partial pressure of hydrogen.
4. The reaction rate decreased with the increase in temperature between 650-800° C. Various explanations like imperfections in the crystal lattice, presence of impurities, sintering of reaction products, and/or formation of dense iron layer around wüstite, and Hedvall effect may be responsible.

The reduced product at 1000° C. was investigated for signs of sintering using SEM microscopy, but no evidence for sintering was observed. Sintering is even more unlikely to occur at lower temperatures, as relatively higher temperatures promote sintering.

Diffusion and Chemical Reaction in an Iron Ore Concentrate Bed

The proposed industrial process for reducing iron ore concentrate using hydrogen gas is to form a loose layer or bed of the iron ore concentrate and pass hydrogen gas over it. To maximize the productivity, for a given bed size (depth of bed), the process must be provided with a sufficient amount of hydrogen in the reducing gas, and the operating temperature has to be raised to such a level that the reaction occurs mainly under the control of interparticle diffusion. In many such cases, there is a limit to which the operating temperature can be raised. The existence of a maximum temperature of operation is, in addition to issues related to materials of construction, energy requirement, and operating difficulties, due to an increase in sintering in the product at higher temperatures, which affects the overall reduction and is undesirable in general.

If the shape and size of the iron ore concentrate layer (or bed) is known and the particle kinetics of iron ore concentrate in a hydrogen atmosphere over the operating conditions is available, the progress of reduction can be modeled for reactions under both predominantly interparticle diffusion control and mixed control. Models for predicting the progress of reaction under specific conditions are discussed herein. The validity of the models in predicting the overall reduction can be established by comparing the modeling results to experimentally observed results.

Experimental Setup

The material and experimental apparatus used for measuring the change in mass of a loose layer of iron ore concentrate during reduction under the control of interparticle diffusion is almost identical to the setup described previously. The sample holder used in this case was modified to accommodate a loose layer of particles with a specified layer depth. In this case, the samples were placed inside ceramic crucibles with circular cross-sections and a designated depth. The filled crucibles were then placed inside a wire basket, and the entire arrangement was suspended from the electronic balance. When the sample holder was suspended from the electronic balance, the crucible was in an upright position and was freely suspended inside the furnace tube. For the experiment, the crucible was filled to the rim with a loosed layer of concentrate particles. The layer of particles was flush with the top of the crucible, and during reduction, only the top surface of the particle bed was exposed to the gas mixture inside the furnace.

Model for Reduction Under Interparticle-Diffusion Control

Two different approaches were used to model the interparticle-diffusion controlled reduction, based on the number of sub-oxides considered to be present during the reduction.

Two-Step Model

Iron ore concentrate is primarily composed of magnetite. The reduction of magnetite at temperatures above 570° C. occurs via the formation of wüstite.

In general, for conditions when the reduction occurs under the control of interparticle-diffusion, both sub-oxides can be present simultaneously during the reduction. Magnetite first transforms to wüstite before converting to iron. As the two reductions have different equilibrium water vapor/hydrogen ratios, there will be two reaction interfaces inside the solid layer reacting under diffusion control—one of the interfaces is between iron and wüstite, and the other is between wüstite and unreacted magnetite. A model has been developed to predict the progress of magnetite reduction accounting for the presence of a wüstite layer and is called the two-step model.

In this model, wüstite is represented as FeO, and its thermodynamic properties are used for calculating the equilibrium. However, strictly speaking the wüstite is a non-stoichiometric compound $FeO_x$ (where the value of x is less than 1). The value of x is dependent on the temperature. Still, the composition of wüstite (x) in equilibrium with iron between 576-910° C., which is the main temperature range of interest, is between 0.93 and 0.96. The ratio of partial pressures of hydrogen-water vapor in equilibrium with wüstite and iron is almost unchanged when the stoichiometric oxide (FeO) is used instead of a non-stoichiometric oxide ($Fe_xO$), as has been demonstrated in FIG. 2. The reactions are thus simplified as the following:

$$H_2(g)+Fe_3O_4(s)\rightarrow H_2O(g)+3\ FeO(s) \quad [4.1]$$

$$H_2(g)+FeO(s)\rightarrow H_2O(g)+Fe(s) \quad [4.2]$$

The shape of a solid influences the conversion-time relationship of a fluid-solid reaction. One of the ways to include the effect of shape on the conversion-time of a fluid-solid reaction is through the definition of a shape factor ($F_p$). The validity of this approach has been demonstrated for any arbitrary shape by Sohn and coworkers. The shape factor value is largely independent of the rate-controlling process for the reaction and will also be described in greater detail hereafter. The characteristic length of the solid associated with the shape factor is defined as follows:

$$l_p \text{ or } r_p = \frac{F_p V_p}{A_p} \quad [4.3]$$

where $F_p$ is the shape factor (=1, 2, or 3 for infinite slabs, long cylinders, or spheres), $V_p$, and $A_p$ are the volume and external surface area of the solid.

Figure 13:
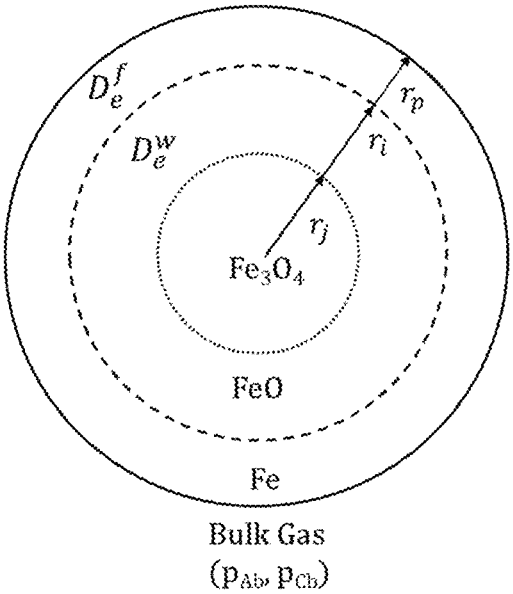
FIG. 13 shows a schematic of a partially reduced magnetite solid ($F_p$=3) reacting under the control of interparticle-diffusion.

According to this two-step model, during reduction, there will be concentric zones of iron, wüstite, and unreacted magnetite, as shown schematically in FIG. 13.

Due to the stoichiometry of the reactions involved, this is a case of equimolar counter diffusion. Assuming a pseudo-steady state condition, the equation of continuity for hydrogen (A) through one of the concentric zones (z) is simplified to the following equation:

$$\frac{d}{dr}\left(D_e^Z r^{F_p-1}\frac{dC_A}{dr}\right)=0 \quad [4.4]$$

where $D_e^z$ is the effective diffusivity of hydrogen in a concentric zone denoted by 'z', since the effective diffusivity is a constant within each zone.

Equation [4.4] can be divided by the effective diffusivity ($D_e^z$) to obtain the governing equation applicable to all the zones. Integrating the expression obtained by dividing Eq. [4.4] through by the effective diffusivity, Eq. [4.5] is obtained. Equation [4.5] is applicable for all the concentric zones:

$$\frac{dC_A}{dr} = \frac{C_1}{r^{F_p-1}} = C_1 r^{1-F_p} \quad [4.5]$$

$$C_A = \frac{C_1 r^{2-F_p}}{(2-F_p)} + C_2 \quad [4.6]$$

At $r=r_p$, $C_A=C_{Ab}$; and at $r=r_i$, $C_A=C_{Ae}^i$ and thus $$C_1 = \frac{(2-F_p)(C_{Ab}-C_{Ae}^i)}{r_p^{2-F_p}-r_i^{2-F_p}} \quad [4.7]$$

By extension, the flux of A, $N_A$ at the wüstite-iron interface (i) is described as follows $$N_A = -D_e\cdot\frac{dC_A}{dr} = -D_e\cdot C_1 r^{1-F_p} = -D_e\cdot\frac{(2-F_p)(C_{Ab}-C_{Ae}^i)}{r_p^{2-F_p}-r_i^{2-F_p}}r^{1-F_p} \quad [4.8]$$

In terms of partial pressures, $$N_A = -D_e\cdot\frac{(2-F_p)}{RT}\cdot\frac{p_{Ab}-p_{Ae}^i}{r_p^{2-F_p}-r_i^{2-F_p}}r^{1-F_p} \quad [4.9]$$

Similarly, for the wüstite-magnetite interface (j), $$N_A = -D_e\cdot\frac{(2-F_p)}{RT}\cdot\frac{p_{Ae}^i-p_{Ae}^j}{r_i^{2-F_p}-r_i^{2-F_p}}r^{1-F_p} \quad [4.10]$$

For a solid with a shape-factor $F_p$ and a characteristic length of $r_p$, the volume of the solid ($V_p$) is related to the characteristic length ($r_p$) as follows:

$$V_p \propto r_p^{F_p} \quad [4.11]$$

Combining Eq. [4.3] with Eq. [4.11], $$A_p=(\beta/r_p)r_p^{F_p} \quad [4.12]$$

where β is a constant that depends on the solid geometry.

The reaction surface area ($S_i$) is related to the position of the interface ($r_i$) as follows:

$$S_i=\beta r_i^{(F_p-1)} \quad [4.13]$$

From Eq. [4.12], $$\beta=A_p r_p^{1-F_p} \quad [4.14]$$

Therefore, from Eqs. [4.13] and [4.14], $$S_i = A_p\cdot\left(\frac{r_i}{r_p}\right)^{F_p-1} \quad [4.15]$$

where $A_p$ is the outer surface area of the solid, and β is a constant that depends on the geometry of the solid.

The total rate of transfer of A at any r in the iron layer is:

$$(S\cdot N_A)_f = -D_e^f\cdot A_p r_p^{1-F_p}\cdot\frac{(2-F_p)}{RT}\cdot\frac{p_{Ab}-p_{Ae}^i}{r_p^{2-F_p}-r_i^{2-F_p}} \quad [4.16]$$

Equation [4.16] will be reduced to the following form for the case of $F_p=2$, by applying L'Hospital's Rule:

$$(S\cdot N_A)_f = -D_e^f\cdot A_p\cdot\frac{1}{RT}\cdot\frac{(p_{Ab}-p_{Ae}^i)}{\ln\left(\frac{r_p}{r_i}\right)}\cdot\frac{1}{r_p} \quad [4.17]$$

The total rate of transfer of A at any r in the wüstite layer is:

$$(S\cdot N_A)_w = -D_e^w\cdot A_p r_p^{1-F_p}\cdot\frac{(2-F_p)}{RT}\cdot\frac{p_{Ae}^i-p_{Ae}^j}{r_i^{2-F_p}-r_j^{2-F_p}} \quad [4.18]$$

Equation [4.18] will be reduced to the following form for the case of $F_p=2$ by applying L'Hospital's Rule:

$$(S\cdot N_A)_w = -D_e^w\cdot A_p\cdot\frac{1}{RT}\cdot\frac{(p_{Ae}^i - p_{Ae}^j)}{\ln\left(\frac{r_i}{r_j}\right)}\cdot\frac{1}{r_p} \quad [4.19]$$

Under pseudo-steady state conditions, the total rate of hydrogen reaching the iron-wüstite and wüstite-magnetite interfaces must be used to react with oxygen inside those interfaces:

$$\rho_m^{app}\cdot S_j\cdot\frac{dr_j}{dt} + \rho_w^{app}\cdot\left(S_i\cdot\frac{dr_i}{dt} - S_j\cdot\frac{dr_j}{dt}\right) = (S\cdot N_A)_f \quad [4.20]$$

$$\rho_m^{app}\cdot S_j\cdot\frac{dr_j}{dt} = (S\cdot N_A)_w \quad [4.21]$$

Based on the stoichiometry of equation [4.1], $$\rho_w^{app}=3\rho_m^{app} \quad [4.22]$$

On simplification, the rate of movement of the interfaces is as follows:

$$\frac{dr_j}{dt} = \frac{(S\cdot N_A)_w}{\rho_m^{app}\cdot S_j} \quad [4.23]$$

$$\frac{dr_i}{dt} = \frac{(S\cdot N_A)_f + 2(S\cdot N_A)_w}{\rho_w^{app}\cdot S_i} \quad [4.24]$$

Equations [4.23] and [4.24] need to be solved by simultaneous numerical solution at every time step to obtain $r_i$ and $r_j$ as a function of time.

The fraction of oxygen still unreacted at any time (t) is given by the following equation:

$$Y(t) = \frac{1\cdot\rho_w^{app}\cdot\left(r_i^{F_p} - r_j^{F_p}\right) + 4\cdot\rho_m^{app}\cdot\left(r_j^{F_p}\right)}{4\cdot\rho_m^{app}\cdot r_p^{F_p}} \quad [4.25]$$

At any time t, the fraction of reduction, X, is related to Y as follows:

$$X(t)=1-Y(t) \quad [4.26]$$

In order to calculate the conversion-time relationship according to the model described above, the parameters of the models have to be estimated, initial conditions are to be set, and a numerical method has to be used.

The methodology for estimating the values of parameters is described subsequently.

Calculation of Apparent Densities and Porosities

From the density of the pure species I ($\rho_I'$) their true molar densities ($\rho_I$) can be calculated as follows:

$$\rho_I = \frac{\rho_I'}{M_I} \quad [4.27]$$

where $M_I$ is the molecular weight ($gmol^{-1}$) of species I.

The initial porosity of the magnetite solid is denoted as $\varepsilon_m$. In a solid, the volume fraction occupied by an inert material can be estimated if the average mass fraction and the average density of the inert material of gangue are known. By assuming that the inert material/gangue is entirely composed of silicon dioxide, inert volume fraction ($\varepsilon_i$) is:

$$\varepsilon_i = \frac{F}{\rho_S'}\Big/\left(\frac{F}{\rho_S'} + \frac{1-F}{\rho_m'}\right) \quad [4.28]$$

F is the average mass fraction of gangue in the magnetite and $\rho_s'$, $\rho_m'$ are the true densities of silicon dioxide and magnetite, respectively.

The porosity of a solid is dependent on the conversion of the solid. Considering a reaction where one mole of solid reactant (B) is transformed into N moles of a product solid (D). If the solid is made up of the reactant (B) along with some inert material and has some porosity, the following equation can be written involving volume fractions:

$$\alpha_{B0}+\varepsilon_0+\varepsilon_i=1 \quad [4.29]$$

where $\alpha\beta_0$ is the volume fraction of the reactant (B), $\varepsilon_0$ is the initial porosity of the solid, and $\varepsilon_i$ is the volume fraction occupied by inert solids.

Further assuming that there is no overall volume change for the solid, at any time during the reaction, the following volume balance equation can be written:

$$\alpha_B+\alpha_D+\varepsilon+\varepsilon_i=1 \quad [4.30]$$

where $\alpha_B$ and $\alpha_D$ are the volume fraction of the reactant (B) and product (D), respectively, and E is the porosity in the solid at that time.

Equating Eqs. [4.29] and [4.30] and rearranging it, $$\varepsilon=\varepsilon_0+\alpha_{B0}-\alpha_B-\alpha_D \quad [4.31]$$

The initial volume fractions of reactant ($\alpha_{B0}$) can be written in terms of the initial number of moles of B ($n_{B0}$), the overall solid volume (V), and molar density of B ($\rho_B$) as follows:

$$\alpha_{B0} = \frac{n_{B0}}{\rho_B V} \quad [4.32]$$

If x moles of B have reacted up to any time, then the volume fractions of the reactant ($\alpha_B$) and product ($\alpha_D$) can be expressed as follows:

$$\alpha_B = \frac{n_{B0} - x}{\rho_B V} \quad [4.33]$$

$$\alpha_D = \frac{Nx}{\rho_D V} \quad [4.34]$$

where N is the number of moles of product (D) formed from every mole of reactant (B), and the molar density of product (D) is expressed as $\rho_D$.

Then the fraction of reactant solid (B) remaining at any time ($Y_{B-D}$) can be expressed as follows:

$$Y_{B-D} = \frac{n_B}{n_{B0}} = \frac{n_{B0} - x}{n_{B0}} \quad [4.35]$$

By substituting the value, the expressions for volume fractions Eq. [4.31] may be rearranged as follows:

$$\varepsilon = \varepsilon_0 + n_{B0}(1 - Y_{B-D})\left(\frac{1}{\rho_B V} - \frac{N}{\rho_D V}\right) \quad [4.36]$$

$$\varepsilon = \varepsilon_0 + (1 - Y_{B-D})\alpha_{B0}\left(1 - N\frac{\rho_B}{\rho_D}\right) \quad [4.37]$$

$$\varepsilon = \varepsilon_0 + (1 - Y_{B-D})(1 - \varepsilon_0 - \varepsilon_i)\left(1 - N\frac{\rho_B}{\rho_D}\right) \quad [4.38]$$

Using Eq. [4.38] the porosity of a product solid (D) can be calculated if the degree of conversion ($1-Y_{B-D}$) and some of the characteristics of the reactant solid ($\varepsilon_0$, $\varepsilon_i$, $\rho_B$) and the reaction (N, $\rho_D$) are known. N is the number of moles of product (D) formed from every mole of reactant (B).

In the case of iron ore concentrate reduction, the porosity is different in each of the different zones of a partially-reacted pellet. In the case of this reduction, within each layer, the conversion is complete, i.e. $Y_{B-D}=0$. The porosity of the wüstite layer and the iron layer are denoted by $\varepsilon_w$ and $\varepsilon_f$, respectively. Their values were calculated using Eq. [4.38].

$$\varepsilon_w = \varepsilon_m + (1 - \varepsilon_m - \varepsilon_{in})\cdot\left(1 - 3\frac{\rho_m}{\rho_w}\right) \quad [4.39]$$

$$\varepsilon_f = \varepsilon_m + (1 - \varepsilon_m - \varepsilon_{in})\cdot\left(1 - 3\frac{\rho_m}{\rho_f}\right) \quad [4.40]$$

The porosity of a loosely packed bed of particles with particle sizes below 100 microns was measured by the water displacement method and found to be around 50%. Thus the initial porosity of the magnetite solid was set at 50% ($\varepsilon_m$=0.5). It was assumed that all the gangue, which is about 3%, by weight, was solely made of $SiO_2$, which was used to calculate the volume fraction occupied by inert solid ($\varepsilon_i$=0.06).

Estimation of Effective Diffusivity

The molecular diffusivity was calculated using the empirical formula below:

$$D_{12} = 3.16\times10^{-4}\frac{T^{1.75}}{p(v_1^{1/3} + v_2^{1/3})^2}\left(\frac{1}{M_1} + \frac{1}{M_2}\right)^{1/2}, \text{ in cm}^2/\text{s} \quad [4.41]$$

The effective diffusivity in a zone j ($D_e^j$), is a function of the molecular diffusivity ($D_{12}$), the porosity of the zone ($\varepsilon_j$), and the tortuosity ($\tau$). The governing relationship is as follows:

$$D_e^j = \varepsilon_j \times \frac{D_{12}}{\tau} \quad [4.42]$$

A commonly used estimate for tortuosity is given by:

$$\tau = 1/\varepsilon_j \quad [4.43]$$

In the case of this two-step model for magnetite reduction, the porosity of the layers was estimated by Eqs. [4.39] and [4.40]. For common fluid-solid reactions, the solids typically have tortuosity values between 1.5 and 10. The larger the value of tortuosity the lower the effective diffusivity signifying dense structure. In the case of gases diffusing into highly dense solids, tortuosity values as large as 60 have been reported. A more exact value of tortuosity can be obtained by fitting the calculated conversion-time relationship to experimental data.

Calculation of Equilibrium Partial Pressures

The equilibrium partial pressures of hydrogen (A) at the reaction interfaces can be calculated by considering the equilibrium constant of the reaction occurring at each of the interfaces.

In general, the reacting atmosphere can be composed of the reactant hydrogen (A), product water vapor (C), and inert gases (I). The total pressure of the gas in the furnace (P) is given by:

$$P = p_A + p_C + p_I \quad [4.44]$$

Assuming that the total pressure within the solid is unchanged during the reduction by applying Eq [4.44] for the bulk gas (represented by subscript b) and the reaction interface (represented by subscript e), the following equations can be written:

$$p_{Ab} + p_{Cb} = p_{Ae} + p_{Ce} = P - p_{Ib} \quad [4.45]$$

$$p_{Ce} = P - p_{Ib} - p_{Ae} \quad [4.46]$$

From the definition of equilibrium constant ($K_e$), $$K_e = \frac{p_{Ce}}{p_{Ae}} = \frac{P - p_{Ib}}{p_{Ae}} - 1 \quad [4.47]$$

Rearranging, $$p_{Ae} = \frac{P - p_{Ib}}{1 + K_e} \quad [4.48]$$

For FeO/Fe interface (i), $$p_{Ae}^i = (P - p_{Ib})/(1 + K_{ei}) \quad [4.49]$$

For $Fe_3O_4$/FeO interface (j), $$p_{Ae}^j = (P - p_{Ib})/(1 + K_{ej}) \quad [4.50]$$

where $p_{Ib}$ is the partial pressure of inert gases in the bulk.

Initial Condition

At the start of the reaction, t=0, for a pore-diffusion-controlled reaction, the rate at which the reaction fronts progress inwards is mathematically infinite. Due to the mathematical form of Eqs. [4.19] and [4.20], this initial condition cannot be applied in the numerical solution procedure. Therefore, the numerical program was run with the initial condition where the overall conversion (X) is very slightly greater than zero. The initial condition used is given by Eq. [4.51]. It was verified that the choice of the initial condition did not significantly affect the result:

$$\text{At } t = 0,\ \frac{r_j}{r_p} = 0.998 \text{ and } \frac{r_i}{r_p} = 0.999 \text{ or } X = 0.004 \quad [4.51]$$

This model can also be applied for calculating the conversion-time relationship for the case of hematite reduction under pore-diffusion control. In the case of hematite reduction, in addition to magnetite and wüstite, hematite may also be present during reduction. The presence of hematite will mean an additional zone. There will also be one more coupled continuity equation for the transport of gases through the magnetite zone. In general terms, the hematite reduction is an example of a reduction system with multiple possible suboxides reacting under control of diffusion. Additional discussion on this is presented in the Appendix of the provisional application.

Numerical Method

An RK-4 method was used to simultaneously solve Eqs. [4.19] and [4.20] using a time step of $10^{-3}$ s. The program was verified to be convergent for the chosen time-step and initial condition.

One-Step Model

Figure 14:
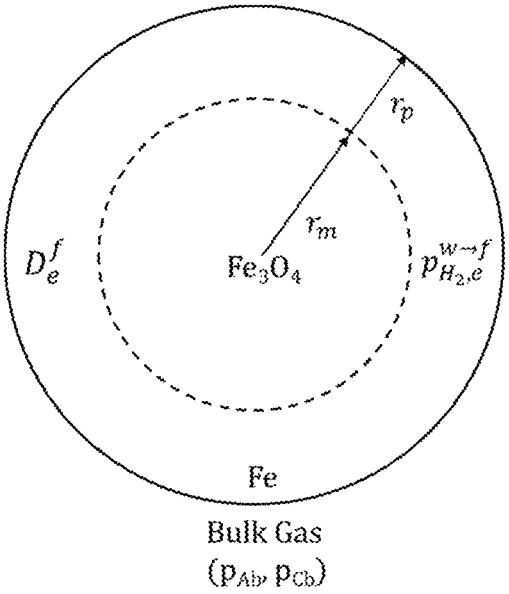
FIG. 14 shows a schematic of a partially reduced magnetite solid ($F_p$=3) reacting under the control of interparticle-diffusion under the assumption of one-step reduction.

The hydrogen reduction of iron ore concentrate under interparticle diffusion can have a layer of wüstite present during the reaction as described herein. From the point of view of chemical equilibrium, the wüstite reduction by hydrogen is the most limited by equilibrium. Thus, it is possible to model the reducing solid, an unreacted magnetite core surrounded by a product iron layer as an approximation. This is equivalent to assuming that the thickness of the wustite layer is narrow compared with those of iron and magnetite, which has been verified from the result of the two-step model presented above. The reaction occurs at the sharp interface between the iron and magnetite, and the reaction is limited by the wüstite-iron-hydrogen-water vapor equilibrium according to the reaction given by equation [4.2]. Since there is only one equilibrium limited step, this model is dubbed the 'one-step model'. The one-step model has two significant advantages compared to the two-step model. First, it simplifies the number of reactions to be considered when modeling the reaction under the control of interparticle diffusion. Second, as has been shown by Sohn and coworkers, the conversion-time relationship for one-step reaction under interparticle-diffusion can be expressed as a function explicit in time. As the conversion functions are time explicit, the application of Sohn's Law of additive times for predicting conversion-time relationships under mixed control conditions is easier. A schematic of the one-step model is presented in FIG. 14.

Sohn and coworkers have generalized the conversion-time relationship for one-step pore-diffusion-controlled reactions based on the shape of the solid, described in terms of the shape factor ($F_p$).

The conversion-time relationship for this case is given by the following equations:

$$p_{F_p}(X) = t^{\dagger} = \frac{2bF_pD_e}{\alpha_B\rho_B}\left(\frac{A_p}{F_pV_p}\right)^2\left(\frac{K}{K+1}\right)\left(C_{A0} - \frac{C_{C0}}{K}\right)t \quad [4.52]$$

$$p_{F_p}(X) = 1 - \frac{F_p(1-X)^{2/F_p} - 2(1-X)}{F_p - 2} \quad [4.53]$$

$p_{F_p}(X)$ is the conversion function under pore-diffusion control for a solid with shape factor ($F_p$). The fraction of volume of solid occupied by magnetite and the true molar densities of magnetite are denoted as $\alpha_B$ and $\rho_B$, respectively. K is the equilibrium constant for the wüstite to iron reduction by hydrogen.

The porosity of the iron layer was calculated by Eq. [4.40]. The effective diffusivity used for this model was calculated based on Eqs. [4.41]-[4.42]. The appropriate value of tortuosity for the iron layer was estimated by comparing the conversion-time data for different tortuosity to the conversion-time data obtained experimentally from reactions under diffusion control.

Comparison of One-Step Vs. Two-Step Model

To apply the two models discussed, it is necessary to have an estimate of the effective diffusivity values. The effective diffusivities were estimated by fitting the conversion-time relationship obtained from the models to conversion-time data for reduction of magnetite bed in hydrogen under the control of interparticle-diffusion.

To obtain the conversion-time data for interparticle-diffusion controlled reduction, a loosely packed flat bed of iron ore concentrate was reduced in a hydrogen atmosphere. The shape factor ($F_p$) for this flat bed is 1, and the characteristic length is equal to the depth of the bed, since only the top surface of the bed was exposed to hydrogen. The external mass transfer resistance was eliminated by increasing the flow rate of hydrogen until it stopped having an effect on the rate of reduction.

For an isothermal reaction controlled by interparticle-diffusion, the time to achieve a given conversion is inversely proportional to the square of the characteristic length and the diffusivity. To ensure that the reactions were interparticle-diffusion controlled the conversions (X) against $t/(r_p^2D_{AC})$ were compared for the reduction of concentrate beds with different heights, where t is time to achieve a conversion of X, and $r_p$, and $D_{AC}$ are the characteristic lengths of the solid and molecular diffusivity of hydrogen-water vapor (A-C) system at the reduction temperature, respectively. The value of diffusivity ($D_{AC}$) was calculated according to the equation [4.41].

From the plots of conversions (X) versus $t/(r_p^2D_{AC})$ in FIGS. 15A-15C, it can be seen that when the height of the bed was 1.76 cm or greater, the X vs. $t/(r_p^2D_{AC})$ were identical. This indicated that the rate of reduction was controlled by the interparticle-diffusion of hydrogen in the iron ore concentrate when the bed height was greater than 1.76 cm.

Also, it is noted that the experimentally measured time for conversion is much longer than that for the reaction occurring under particle kinetics or reaction control. A comparison has been presented in FIG. 16, as an example, for reduction at 900° C. and with pure hydrogen. The experimentally measured time to achieve 90% conversion is ~25 times longer compared to the time for achieving the same conversion under the control of particle kinetics. The smaller plot inside of FIG. 16 represents the initial section ($t/(r_p^2D_{AC})$: 1-5) of the overall plot.

Based on the discussion related to FIGS. 15A-15C and FIG. 16, it can be stated that experimentally obtained conversion-time relationship for reduction where the depth of the bed was 1.76 cm or greater occurs predominantly under the control of interparticle-diffusion. These experimental data were used to estimate the tortuosity for the iron-ore concentrate bed for the two models at different temperatures, and the results are presented in FIGS. 17A-17D.

It was found that both the models discussed above could predict the nature of the conversion-time relationship for the reaction occurring under the control of interparticle-diffusion. The effective diffusivity or the tortuosity value could be estimated by comparing the experimental value to the two models. It was found that at temperatures between 850-1000° C., when the value of tortuosity ($\tau$) was set at 1.5, the conversion-time relationship calculated using the one-step model was a good approximation of the experimental results. At 650° C., the appropriate value of tortuosity was estimated to be 3.2 for the one-step.

In the two-step model, the tortuosity value for the iron layer was kept the same as the one-step model over the same temperature range. The appropriate value of tortuosity for the wüstite layer was found by varying it between 1.5 and 20 and comparing the calculated conversion-time to the experimentally obtained conversion-time data. The best-fit was obtained when the tortuosity value for the wüstite layer was set at 20 for all the cases studied between 650-1000° C.

The progress of reaction inside the solids can be predicted from these models. In the case of interparticle-diffusion controlled reduction, the reaction(s) occur at sharp interfaces and progresses into the reacting solid with the passage of time. The position of the reaction fronts inside the solid for the two-step model is given by Eqs [4.19] and [4.20]. In contrast, for the one-step model, the reaction occurs exclusively at the iron-magnetite interface inside the solid. The conversion-time (X–t) relationship for the one-step model is given by Eqs. [4.52] and [4.53] and based on the numerical value of conversion (X), the position of the reaction front was estimated.

As it was assumed that the overall shape of the solid did not change, the conversion was written in terms of the initial volume of the solid ($V_0$) and the volume of unreacted solid (V) at any time during the reaction was as follows:

$$X = \frac{V_0 - V}{V_0} \quad [4.54]$$

Rearranging, $$\frac{V}{V_0} = 1 - X \quad [4.55]$$

Substituting the volume of the solid in terms of the shape factor ($F_p$), the following equation is obtained:

$$\frac{r}{r_p} = (1 - X)^{1/F_p} \quad [4.56]$$

Equation [4.56] was used to obtain the position of the reaction front inside the solid ($r_i$) as a function of time when the overall size ($r_p$) and shape factor of the solid ($F_p$) were known along with its conversion-time (X–t) relationship.

The positions of the reaction interface were obtained for reactions under interparticle-diffusion control at different temperatures from both the one-step and the two-step models, and results are presented in FIGS. 18A-18D. For the purpose of comparison, the position reaction front was normalized with the overall size of the solid, and the time was normalized with the time for achieving 100% conversion ($t_{X=1}$).

From FIGS. 18A-18D, it was observed that according to the two-step model the size of the wüstite layer increased steadily with the progress of the reaction. However, the relative size of the wüstite layer was small up to a high degree of conversion. Consequently, the positions of the reaction interfaces from the two-step model and the one-step model were close together up to a high reduction degree. This signified that the one-step model is a good approximation for the two-step model. This is particularly significant as the one-step model is more convenient to apply and can reasonably approximate the progress of the overall reaction. Moreover, as the one-step model gives a closed-form conversion-time relationship, Sohn's law of additive reaction times can be used to predict conversion-time relationships for reactions happening under mixed control, as will be demonstrated subsequently.

Model for Reduction Under Mixed Control

In the context of the proposed ironmaking process, depending on the conditions, the reduction rate can be controlled by particle kinetics or by interparticle-diffusion, or both particle kinetics and interparticle-diffusion can simultaneously have a comparable contribution to the rate. The situation where both particle kinetics and interparticle diffusion have comparable contribution to the overall rate of reduction is called mixed control.

A schematic illustrating the reduction of iron ore concentrate under inter-particle diffusion control vis-à-vis mixed control is presented in FIGS. 19A-19B. As was established in the previous section, the one-step model can approximate the progress of the reaction controlled by interparticle-diffusion. In a bed of iron ore concentrate being reduced by hydrogen from one surface under the control of interparticle-diffusion, there will be a sharp boundary between the product iron layer and the unreduced layer of iron ore concentrate on the bottom, as shown in FIG. 19A. In contrast, the reaction happens over a diffuse reaction zone when the same bed is reduced under mixed control. The top of the bed will have completely reduced particles. However, the degree of reduction of the particles decreases progressively down the depth of the bed, eventually leading to completely unreduced particles, as depicted in FIG. 19B.

The particle kinetics has been described previously, and the models above have described the rate under the control of interparticle diffusion. This section describes the methods for utilizing the developed rate equations in calculating the conversion-time data for reactions under mixed control.

Model for Mixed Control using Global Particle Kinetics

In their work on iron oxide reduction, Sohn and Chaubal had developed a general method to rigorously describe the conversion-time relationship for reactions involving multiple steps occurring in mixed control conditions. Although magnetite reduction can have multiple intermediate steps, the developed particle kinetics is a global rate equation instead of separate rate equations for each of the intermediate steps. Thus, in this case, the method proposed by Sohn and Chaubal was adapted for using the global particle kinetics to predict the conversion-time relationships for reductions occurring under mixed control. For convenience, this model is dubbed as the 'Rigorous Model' and as in the case of interparticle-diffusion control reaction, this model also needs an estimate for effective diffusivity. In a similar approach to interparticle-diffusion control cases, an estimate for the tortuosity and by extension the effective diffusivity can be obtained by fitting the model to the experimental conversion-time data from reactions under diffusion control. After obtaining the estimate for effective diffusivity, the model was used to calculate conversion-time data under mixed control conditions. The calculated results were compared to the experimental data under mixed control conditions.

In general, an overall fluid-solid reaction is given by the following equation:

$$A(g)+bB(s)=cC(g)+dD(s) \quad [4.57]$$

For this study, the specific overall or global reaction is given as follows:

$$H_2(g)+\tfrac{1}{4}Fe_3O_4(s)=H_2O(g)+\tfrac{3}{4}Fe(s) \quad [4.58]$$

Equation [4.58] describes the reduction of an iron ore concentrate (magnetite) agglomerate by hydrogen. It is a specific case of the general reaction presented in Eq. [4.57]. From the comparison, $H_2$, $Fe_3O_4$, $H_2O$, and Fe were denoted as A, B, C, and D, respectively, for the subsequent derivation. Accordingly, the value of the stoichiometric coefficients b, c, and d was set as ¼, 1, and ¾, respectively. The model that is given subsequently is derived based on the general notations used in Eq. [4.57].

The equation of continuity for the hydrogen (A) is as follows:

$$\varepsilon\frac{\partial C_A}{\partial t}+\nabla\cdot(C_A V)-\nabla\cdot(D_{eA}C\nabla x_A)+v_A=0 \quad [4.59]$$

The second term on the left side of the equation describes the contribution due to bulk flow which is not present for hydrogen reduction of magnetite, and hence the equation becomes, after applying the pseudo-steady-state approximation $$\nabla\cdot(D_{eA}C\nabla x_A)-v_A=0 \quad [4.60]$$

where $v_A$ represents the consumption rate of A per unit volume of the overall solid. If the shape of the solid can be described by a shape factor ($F_p$), and the effective diffusivity ($D_{eA}$) can be approximated by a constant, the equation of continuity can be simplified as follows for the three basic geometries:

$$\frac{D_{eA}}{r^{F_p-1}}\left(\frac{\partial}{\partial r}\left(r^{F_p-1}\frac{\partial x_A}{\partial r}\right)\right)-\frac{RT}{P}v_A=0 \quad [4.61]$$

In terms of the global reaction rate of magnetite, the consumption term is given as follows:

$$v_A=-\frac{1}{b}\alpha_B\rho_B\frac{\partial Y}{\partial t} \quad [4.62]$$

$\alpha_B$ and $\rho_B$ are the volume fraction, and true molar density of magnetite (B) and Y is the local fraction of magnetite remaining. As the global rate of reduction of magnetite concentrate by hydrogen is given by a nucleation growth model, the instantaneous rate in term of fractional oxygen remaining for a model with Avrami parameter of m is as follows:

$$-\frac{\partial Y}{\partial t}=mk_{app}Y(-\ln Y)^{1-\frac{1}{m}} \quad [4.63]$$

where $$k_{app}=k_0P(x_A-x_C/K) \quad [4.64]$$

$x_A$ and $x_C$ are the mole fractions of hydrogen (A) and water vapor (C), respectively.

The consumption term in Eq. [4.61] is given as follows:

$$\frac{RT}{P}v_A=\frac{RRTm\alpha_B\rho_B}{b}k_0\left(x_A-\frac{x_C}{K}\right)Y(-\ln Y)^{1-\frac{1}{m}} \quad [4.65]$$

The effective diffusivities of A and C were assumed to be equal, even when there is Knudsen diffusion.

$$D_e=D_{eA}=D_{eC} \quad [4.66]$$

The effective diffusivity is defined based on Eq. [4.42]. The porosity is a function of conversion, the porosity term in Eq. [4.42] is given by the following equation:

$$\varepsilon=\varepsilon_0+(1-Y)(1-\varepsilon_0-\varepsilon_i)\left(1-3\frac{\rho_B}{\rho_D}\right) \quad [4.67]$$

The tortuosity value is obtained from the experimental data under diffusion control.

The reduction is an equimolar reaction, as thus the rate of consumption of A per unit volume ($v_A$) is related to the rate of generation of C per unit volume ($v_C$) as follows:

$$v_A=-v_C \quad [4.68]$$

The equation of continuity equation for product gas C is as follows:

$$D_{eC}r^{1-F_p}\left(\frac{\partial}{\partial r}\left(r^{F_p-1}\frac{\partial x_C}{\partial r}\right)\right)-\frac{RT}{P}v_C=0 \quad [4.69]$$

By dividing Eq [4.69] by K and subtracting it from Eq [4.61], the equation of continuity in terms of the concentration driving force ($x_A-x_C/K$) can be obtained.

$$D_e\cdot\left[\frac{\partial}{\partial r}\left(\frac{\partial}{\partial r}\left(x_A-\frac{x_C}{K}\right)\right)+(F_p-1)\frac{1}{r}\frac{\partial}{\partial r}\left(x_A-\frac{x_C}{K}\right)\right]-\frac{RT}{P}\left(v_A-\frac{v_C}{K}\right)=0 \quad [4.70]$$

From Eq. [4.68], $$v_A-\frac{v_C}{K}=v_A\left(1+\frac{1}{K}\right) \quad [4.71]$$

In general, Eqs. [4.63] and Eq. [4.70] must be solved simultaneously with the following initial and boundary conditions:

$$\text{At } t=0,\ Y=1 \quad [4.72]$$

$$\text{At } t=0,\ \left(x_A-\frac{x_C}{K}\right)=\left(x_A-\frac{x_C}{K}\right)_b \quad [4.73]$$

$$\text{At } r=0,\ \frac{\partial}{\partial r}\left(x_A-\frac{x_C}{K}\right)=0 \quad [4.74]$$

$$\text{At } r=r_P,\ \left(x_A-\frac{x_C}{K}\right)=\left(x_A-\frac{x_C}{K}\right)_b \quad [4.75]$$

Equation [4.70] can be written in terms of concentration driving force ($x_A-x_C/K$) as follows:

$$\frac{\partial^2}{\partial r^2}\left(x_A-\frac{x_C}{K}\right)+\frac{(F_p-1)}{r}\cdot\frac{\partial}{\partial r}\left(x_A-\frac{x_C}{K}\right)-\frac{RTm\alpha_B\rho_B\left(1+\frac{1}{K}\right)}{b}\frac{k_0}{D_e}\left(x_A-\frac{x_C}{K}\right)Y(-\ln Y)^{1-\frac{1}{m}}=0 \quad [4.76]$$

Now, Eqs. [4.63] and [4.76] were solved simultaneously with Eqs. [4.72], [4.74], and [4.75] as initial and boundary conditions.

The overall conversion in dimensional form for a solid with a shape factor of $F_p$ is:

$$X = \frac{\int_0^{r_p} (1 - Y) \cdot r^{F_p - 1} dr}{\int_0^{r_p} r^{F_p - 1} dr} \quad [4.77]$$

It is noted that the denominator is equal to $r_p^{F_p}/F_p$.

Numerical Method

The differential equations were approximated by algebraic equations using the finite volume method. These algebraic equations were solved over a discretized space and time. A Gauss-Sidel method was used to achieve convergence of variables in space, while an RK-4 method was used to update the variables in time. The characteristic length was discretized into 50 equal intervals, and a constant time-step of $5\times10^{-4}$ s was used. The program was tested for convergence in both space and time.

Estimation of Effective Diffusivity

The optimum tortuosity value of the product layer for the 'Rigorous Model' was estimated as a function of temperature. This was done by fitting calculated conversion-time data from the 'Rigorous Model' to the experimental conversion-time data for reduction under interparticle-diffusion control conditions. FIGS. 20A-20D shows the fitted conversion-time plots at four different temperatures. The appropriate tortuosity was estimated to be 6 between 850-1000° C. and was 13 at 650° C. The optimized tortuosity values were used along with Eqs [4.42] and [4.67] to estimate the effective diffusivity for the 'Rigorous Model'. The model was then used to calculate the conversion-time relationship under mixed control conditions. The comparison of the calculated results to experimental data is discussed subsequently.

Model for Mixed Control Using Sohn's Law

The one-step model was demonstrated to be a good approximation of the conversion-time relationship for magnetite reduction under interparticle-diffusion control. The closed-form conversion-time relationship from the one-step model was used with Sohn's law of additive reaction times to predict conversion-time relationships for the reactions taking place under mixed control.

Sohn's law of additive reaction times states that for isothermal reactions, the time needed for a reaction to achieve a certain degree of conversion is the sum of the time needed for that reaction in the absence of any interparticle-diffusion resistance and the time needed for that reaction under the control of interparticle-diffusion and external mass-transfer:

| | | | | |
|---|---|---|---|---|
| Time required to attain a certain conversion | ≅ | Time required to attain the same conversion under the condition of rapid interparticle-diffusion | + Time required to attain the same conversion under the rate control of interparticle-diffusion and external mass transfer | [4.78] |

or mathematically, $$t \cong t(X)\big|_{fast-diffusion} + t(X)\big|_{diffusion\ control} \quad [4.79]$$

-continued $$t \cong a \cdot g(X) + a \cdot \hat{\sigma}^2 \left[ p_{F_p}(X) + \frac{4X}{Sh^*} \right] \quad [4.80]$$

where a is a constant related to the rate constant of particle kinetics, $\hat{\sigma}^2$ is a fluid-solid-reaction modulus, and Sh* is the modified Sherwood number which is defined as follows:

$$Sh^* = Sh(D/D_e) = \frac{k_m}{D_e}\left(\frac{2F_p V_p}{A_p}\right) \quad [4.81]$$

where $k_m$ is the mass transfer coefficient of the gaseous reactant.

For a solid whose shape is describable by a shape-factor ($F_p$) and which is undergoing a reaction described by Eq. [4.57], the fluid-solid-reaction modulus is defined as follows:

$$\hat{\sigma}^2 = \frac{1}{a}\left(\frac{F_p V_p}{A_p}\right)^2 \frac{\alpha_B \rho_B}{2bF_p D_e\left(c_{A0} - \frac{c_{C0}}{K}\right)}\left(1 + \frac{1}{K}\right) \quad [4.82]$$

Sohn's Law of additive reaction times is particularly advantageous in predicting conversion-time relationship for fluid-solid reactions occurring under mixed control. This approach is particularly attractive from an engineering point of view as it is computationally much simpler compared to a more accurate numerical model presented above.

According to the one-step model, the conversion function for reaction under interparticle-diffusion was derived in the preceding discussion. The applicability of Sohn's Law of additive time was investigated by comparison with experimental data obtained under conditions when mixed control is likely. The results were also compared to the numerical solution of the governing differential equation for mixed control. The reduction of a bed of concentrate is likely to be governed by mixed control if the thickness of the bed is such that it is too thick for being controlled by particle kinetics but is not thick enough to be controlled by interparticle-diffusion. The equivalence in terms of reaction rates, as can be concluded from Eq. [4.79], is that a system reacting under mixed control would need comparable lengths of time for it to reduce either exclusively under the control of particle kinetics or exclusively under the control of interparticle-diffusion.

Comparison of Rigorous Model and Sohn's Law for Mixed Control

Several experiments were conducted between 850-1000° C., and the thickness of the bed was varied in the range where mixed control was expected, and the results are presented in FIGS. 21A-21B and 22A-22B. This temperature range was chosen based on the engineering consideration that reactions at higher temperatures are preferable for industrial purposes as they result in higher production rates.

Figure 21A:
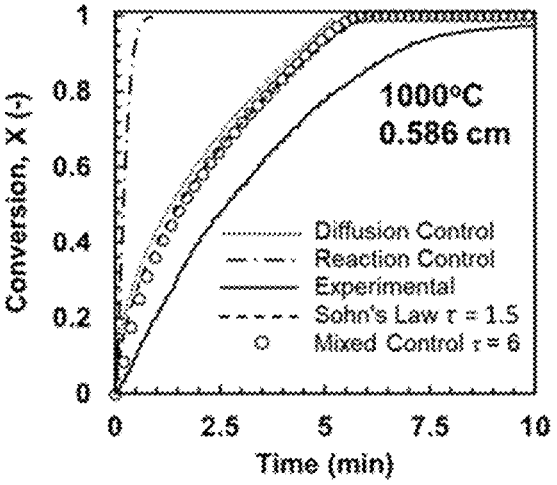
FIGS. 21A-21B show comparison of conversion-time relationship obtained by experiments and by applying Sohn's Law of additive time and the mixed control model for the reduction of a 5.86 mm thick bed by pure hydrogen (P=0.85) at two temperatures.
Figure 21B:
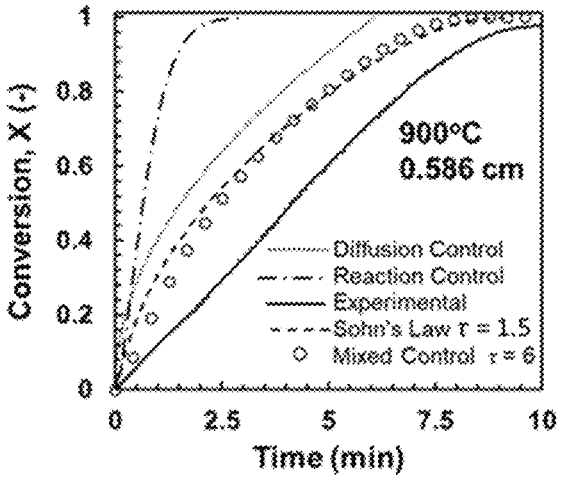
Figure 22A:
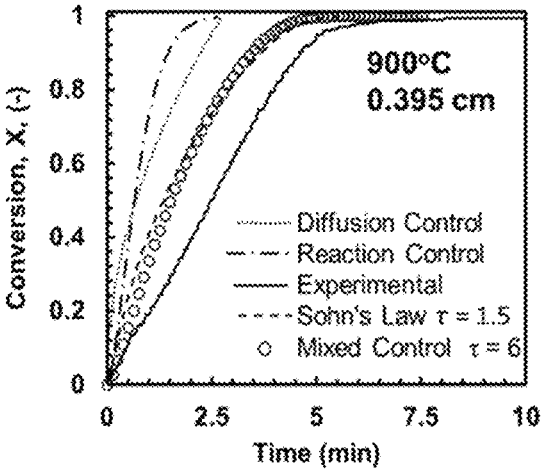
FIGS. 22A-22B show comparison of conversion-time relationship obtained by experiments and by applying Sohn's Law of additive time and the mixed control model for the reduction of a 3.95 mm thick bed by pure hydrogen (P=0.85) at two temperatures.
Figure 22B:
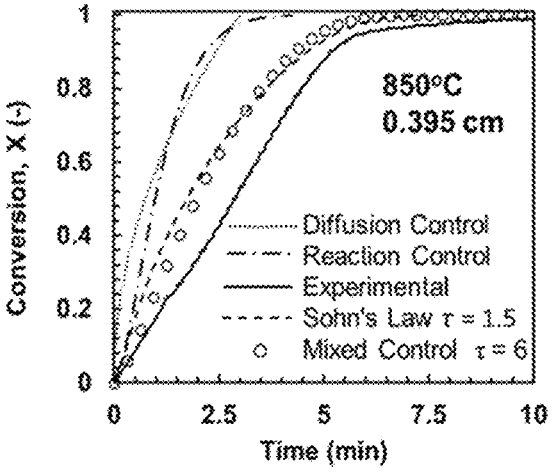

It was observed, from FIGS. 21A-21B, that when the thickness of the iron ore concentrate layer was 5.86 mm, the reduction was not in the mixed control regime, but it was occurring predominantly under the control of interparticle-diffusion control at both 900 and 1000° C. However, the reduction at the lower temperature of 900° C. was influenced more by the particle kinetics. This is expected as the rate of reduction under the control of particle kinetics increases with an increase in temperature over the range of 800-1000° C. For the reduction with a shallower bed thickness of 3.95 mm, it was observed that reduction at 850 and 900° C. by pure hydrogen was occurring under mixed-control conditions, as presented in FIGS. 22A-22B. It was concluded that the reaction was occurring under mixed control as the time to achieve a certain degree of conversion under the control of particle kinetics was comparable to the time for the same under interparticle-diffusion control. Both the models for mixed control, the 'Rigorous Model' and the one-step model, together with Sohn's Law of additive reaction time, could satisfactorily approximate the empirical result. A remarkable agreement was found between the conversion-time relationships obtained from the two different methods, as is evident from both FIGS. 21A-21B and 22A-22B. The significance of this result is that the conversion-time relationship for the iron ore concentrate reduction by hydrogen can be modeled by the one-step model and Sohn's Law of additive reaction time. This is advantageous for engineering purposes as it renders the numerical solution of the differential equations for the mixed control model unnecessary.

Concluding Remarks

The following remarks summarize the significant findings discussed in this section:

1. It was demonstrated that the one-step model, together with Sohn's Law of additive times, could predict the conversion time relationship for magnetite reduction under mixed control conditions. This is particularly relevant from a practical point of view as this obviates complex numerical methods to calculate the conversion-time relationship for iron ore concentrate by hydrogen. Based on this result, the one-step model together with Sohn's Law of additive time was used to describe the reduction rate of iron ore concentrate by hydrogen in a model for the proposed moving bed reactor.
2. Two models were developed for predicting the conversion-time relationship under interparticle diffusion control for fluid-solid reactions with multiple intermediate steps. All possible intermediates phases were considered in the two-step model, and in the one-step model, the amount of oxygen to be removed from magnetite ($Fe_3O_4$) is from the basic stoichiometry but the driving force at the interface is determined by wüstite-iron-hydrogen-water vapor equilibrium. Both models were found to predict the conversion-time relationship accurately.
3. In the case of magnetite reduction, the one-step model had significant advantages over the two-step model. Other than involving fewer reactions to consider, the one-step model yielded a reasonable approximation of the conversion-time relationship as an explicit closed-form expression instead of the numerically implicit form as in the two-step model. This is particularly significant from the engineering point of view as closed-form conversion-time equations can be used to calculate conversion-time under mixed control through Sohn's Law of additive time more simply.
4. Two models were developed for predicting the conversion-time data for reactions under mixed control of interparticle diffusion and particle kinetics. The 'Rigorous Model' was developed to predict the conversion-time relationship for reactions under mixed control conditions when the global particle kinetics of the reaction is known. The other approach was to use the one-step model together with Sohn's Law of additive time.
5. Estimates for the physical properties of both the solid and gas and thermodynamic data of the involved reactions were necessary to implement these models. The estimation of the effective diffusivity was the most critical. The difficulty in assessing effective diffusivity is because the value depends on the structure of the solid and the gas involved. Although generalized approximate methods are available, the best approach for a particular case is to estimate the effective diffusivity values by fitting the models to experimental conversion-time data under the rate control by pore diffusion.

Moving Bed Reactor for Iron Ore Concentrate Reduction

The proposed ironmaking technology is envisioned to be an industrial process. As such, the iron ore reduction by hydrogen is to be performed in a reactor that will maximize the contact between the gas and solid. Three main types of chemical reactors are widely used for gas-solid reactions, namely: fixed bed reactor, moving bed reactor (MBR), and fluidized bed reactor.

A fixed bed reactor is simple in design and robust in operation. Thus, it can have a large size as exemplified by a modern blast furnace. Either a MBR or a fluidized bed can be used for a continuous operation in smaller scale. MBRs are used for commercial processes across several industries such as petrochemical, pyrolysis, and biomass industries. In addition to enabling good contact between fluids and solids, an advantage of MBR is its relatively simple arrangement that can accommodate feed of a wide range of particle sizes. The energy consumption in a MBR are relatively low. Also, the pressure drop across the reactor is lower, resulting in a low maintenance cost and higher net profit.

Fluidized bed ironmaking is also an attractive process for continuous operation because iron ore fines can be used directly. The direct use of fines leads to an increased production rate besides saving on the cost of sintering and the associated emissions. There have been several industrial ironmaking processes that utilize fluidized bed reactors. However, these processes are typically carried out at a higher temperature to increase the rate of reaction, which introduces the operational problems due to particle fusion and defluidization. Sticking of particles in extreme cases can interfere with the continuous ironmaking operation. Also, more generally, fluidized beds operations can result in attrition of particles (particularly weak particles), which can aggravate the sticking problem. For these and other reasons, the fluidized bed process for ironmaking has largely been unsuccessful commercially.

As the proposed process is aimed to operate at a lower temperature, an MBR was selected for this purpose as it can accommodate a wide range of particles or pellets. Also, the operational continuity is unaffected by product particles sticking together.

In the following subsections, the ironmaking process is described. A simplified model of a counter-current moving bed reactor is presented. The model has been applied to design an industrial ironmaking operation based on the proposed technology.

Description of a Moving Bed Reactor

Moving Grate Configuration

MBRs are used in several metallurgical processes. However, the reactors vary considerably in the configuration of the solid, its direction of travel, and the fluid flow. This point is illustrated by taking the example of some of the industrialized ironmaking operations that use MBR. Sintering of iron ore and many of the main ironmaking reactors are MBRs.

For the iron ore sintering process, the MBR comprises a moving or traveling grate, called a sinter strand, on to which a feed mixture, composed of iron ore, limestone, coke dust, etc., is placed. A burner and wind-boxes are placed on the topside and underside of the sinter strand to achieve sintering through the controlled combustion of coke in the sintering mixture. The flow of air is perpendicular to the layer of the sinter mixture placed on the traveling grate. Such systems will be familiar to those of skill in the art.

An example of MBR used as an alternative ironmaking process is a rotary hearth furnace for reducing iron ores with pulverized coal or reducing gases like that generated from devolatization of the coal. An MBR with a counter-current flow of gas and solid is more efficient in terms of energy expenditure and utilization of the chemical potential of the reducing gas. Therefore, a counter-current flow arrangement of the solid and the gas was selected for the proposed ironmaking process. The residence time depends on the reduction rate. For a layer of iron ore concentrate exposed to a reducing gas mixture along one surface, the reaction time is dependent on the characteristic length, which is the thickness of the layer. Therefore, this process is envisioned as having a traveling grate arrangement much like an iron ore sintering machine with a modified flow arrangement of the reduction gas. The gas flows over the iron ore concentrate layer along the length of the reactor parallel to the direction of the moving grate.

Tray on Moving Bed with Green Blocks, Pellets, or Mounds of Concentrate

The elimination of sintering or pelletization steps in ironmaking results in a significant saving of up to 25% as compared to processes that require such steps (e.g., blast furnace reduction). Moreover, the overall energy consumption and emissions for the finished steel product will decrease. As a result, in this proposed ironmaking process, iron ore concentrate may be directly fed into a moving bed reactor in the form of a heap or mound with little pretreatment. The fastest production rate will be achieved when the layer of iron ore concentrate will reduce under the control of interparticle-diffusion. Therefore, it would be best to expose the solid layer to the gas from all sides to improve the reduction rate. However, the most straightforward process will be to put a layer or heap of iron ore concentrate on a tray directly and then place the tray on the traveling grate. The contact area between the solid and the reacting gas can be increased by molding the iron ore concentrate into green blocks with holes through them or pellets and placing them on a porous tray or directly on the traveling grate so that gas can contact the solid from all sides. Sintered and pelletized iron ore concentrate may also be used in this system but doing so has additional costs in terms of energy consumption and emissions, and is not necessary, as described.

For reduction occurring under the control of interparticle diffusion, the time to achieve a certain degree of conversion is proportional to the square of the characteristic length, which is the thickness of the bed or brick or the radius of the pellet. A more detailed discussion on characteristic length, especially for solids with non-basic geometries, can be found above. There is an optimum layer thickness to have a reactor whose length and residence time are in the range comparable to other industrialized processes. As there is an optimum layer size for the process, to utilize the entire reactor volume and to have productivity comparable to established alternative ironmaking reactor, the trays of iron ore concentrate, or pellets can be stacked on top of each other.

Model Formulation

The model is developed considering that the reacting solid is placed as a single layer, i.e., one layer of concentrate on a tray or one layer of pellets or blocks on the moving grate. The reducing gas is fed into the reactor in a counter-current manner. The model is formulated in a generalized way that can accommodate the case when multiple trays or layers are stacked on top of each other in the reactor. A schematic of a counter-current moving bed ironmaking reactor is presented in FIG. 23.

The following assumptions are made for modeling the counter-current moving bed reactor:

The reduction occurs under isothermal conditions.

A plug flow can represent the flow of reducing gas.

The reactor bed moves at a constant velocity.

The iron ore concentrate is of a uniform grade, and the feeding rate is steady.

The reactor has a uniform, rectangular cross-section area.

Mass transfer in the vertical direction of the gas phase is fast compared with diffusion through the bed.

The reduction reaction occurs under a pseudo-steady state condition.

In this proposed ironmaking process, iron ore concentrate (magnetite) is reduced by hydrogen according to the following reaction:

$$H_2(g)+\tfrac{1}{4}Fe_3O_4(s)\rightarrow H_2O(g)+\tfrac{3}{4}Fe(s) \quad [8.1]$$

However, to generalize the model, it is assumed that the fluid-solid reaction occurring in the moving bed reactor is as follows:

$$A(g)+bB(s)\rightarrow cC(g)+dD(s) \quad [8.2]$$

Under the specified condition, the molar rate of consumption of A($\dot{n}_A$) in a control volume located between y and (y+Δy) has the following stoichiometric relationship to the molar rate of consumption of B ($\dot{n}_B$) as follows:

$$\dot{n}_{A_y} - \dot{n}_{A_{(y+\Delta y)}} = \frac{1}{b}\left(\dot{n}_{B_{(y+\Delta y)}} - \dot{n}_{B_y}\right) \quad [8.3]$$

Equation [8.3] has been written in the differential terms and normalized by the cross-sectional area of the reactor ($a_r$) as follows:

$$\frac{1}{a_r}\cdot\frac{d}{dy}(\dot{n}_A) = -\frac{1}{a_r}\cdot\frac{1}{b}\cdot\frac{d}{dy}(\dot{n}_B) \quad [8.4]$$

Similarly, the balance equation in terms A and C can be written.

$$\frac{1}{a_r}\cdot\frac{d}{dy}(\dot{n}_A) = -\frac{1}{a_r}\cdot\frac{1}{c}\cdot\frac{d}{dy}(\dot{n}_C) \quad [8.5]$$

As has been discussed previously, the reduction of iron ore concentrate (magnetite) to iron is equilibrium limited by the reduction of wüstite (FeO) to iron, which is given by equation [8.6].

$$H_2(g)+FeO(s)\rightarrow H_2O(g)+Fe(s) \quad [8.6]$$

Thus, the chemical driving force for the reduction reaction can be expressed as follows:

$$\text{Driving force}=p_A-p_C/K \quad [8.7]$$

where K is the equilibrium constant for the limiting reaction, which in this case is the wüstite reduction reaction given by Eq. [8.6]. As the reaction goes forward, reducing gas (A) is consumed, and product gas (C) is formed, which leads to the driving force diminishing with the progress of the reaction. Thus, the driving force can be normalized as follows:

$$\theta=(p_A-p_C/K)/(p_{A0}-p_{C0}/K) \quad [8.8]$$

The iron oxide reduction reaction is an equimolar counter-reaction (c=1). Thus, Eq. [8.5] was simplified as follows:

$$\frac{1}{a_r}\cdot\frac{d}{dy}(\dot{n}_A)=-\frac{1}{a_r}\cdot\frac{d}{dy}(\dot{n}_C) \quad [8.9]$$

From, Eqs. [8.4] and [8.9], $$\frac{1}{a_r}\cdot\frac{d}{dy}(\dot{n}_C)=\frac{1}{a_r}\cdot\frac{d}{dy}(\dot{n}_B) \quad [8.10]$$

Multiplying Eq. [8.10] through by 1/K, a constant over the length of the reactor (y) because the process is isothermal, and subtracting it from Eq. [8.4], the following expression is obtained:

$$\frac{1}{a_r}\cdot\frac{d}{dy}(\dot{n}_A-\dot{n}_C/K)=-\frac{1}{a_r}\cdot\frac{d}{dy}(\dot{n}_B)\cdot(1+1/K) \quad [8.11]$$

The position where the gas inlet and solid outlet is located for this reactor is y=0. In terms of the normalized driving force (θ), given by Eq. [8.8], the molar rate of the reactant gas A ($\dot{n}_A$) and the product gas C ($\dot{n}_C$) at any position y along the length of the reactor was expressed in the following equation in terms of the molar rates of A and C at y=0, which are denoted by $\dot{n}_{A0}$ and $\dot{n}_{C0}$ for A and C, respectively.

$$(\dot{n}_A-\dot{n}_C/K)=(\dot{n}_{A0}-\dot{n}_{C0}/K)\cdot\theta \quad [8.12]$$

Combining Eqs. [8.11] and [8.12], and rearranging, the rate of change in the driving force of the reducing gas mixture, along the length of the reactor, is related to the rate reduction of the solid (B) as follows:

$$\frac{1}{1+1/K}\cdot\frac{1}{a_r}\frac{d}{dy}((\dot{n}_{A0}-\dot{n}_{C0}/K)\theta)=-\frac{1}{b}\frac{1}{a_r}\frac{d\dot{n}_B}{dy} \quad [8.13]$$

The degree of reduction (X), at any y, in terms of the molar rate of B ($\dot{n}_B$) can be given as follows:

$$X=1-\dot{n}_B/\dot{n}_{BL} \quad [8.14]$$

where $\dot{n}_{BL}$ is the molar rate of B at y=L, which is the solid inlet for the reactor.

When written in differential terms, the following equation can be derived:

$$\frac{d\dot{n}_B}{dy}=-\dot{n}_B\,|_{y=L}\,\frac{dX}{dy} \quad [8.15]$$

By using the express of molar rate of B ($\dot{n}_B$) in terms of degree of conversion (X), given by Eq. [8.15], into Eq. [8.13] the following expression was obtained:

$$\frac{1}{1+1/K}\cdot\frac{1}{a_r}\frac{d}{dy}((\dot{n}_{A0}-\dot{n}_{C0}/K)\theta)=\frac{1}{b}\frac{1}{a_r}\dot{n}_B\,|_{y=L}\,\frac{dX}{dy} \quad [8.16]$$

The molar rates of consumption of the fluid reactant (A) and the reactant solid (B) can be expressed in terms of the molar rate per unit cross-sectional area of the reactor ($a_r$) fluid flowed into the reactor ($G_g$) and the solid stream ($G_s$), respectively.

The mathematical expressions of the molar rate per unit-cross-sectional area of the reactor ($a_r$) for the fluid ($G_g$) in terms of the molar rates of the fluids A and C is given below:

$$G_g=\frac{1}{a_r}(\dot{n}_{A0}+\dot{n}_{C0}) \quad [8.17]$$

where $\dot{n}_{A0}$ and $\dot{n}_{C0}$ are the molar rate of A, C in the reducing gas mixture at y=0.

In the case there are inert gases added to the reacting gas mixture, Eq. [8.17] can be modified as follows:

$$G_g=\frac{1}{a_r}(\dot{n}_{A0}+\dot{n}_{C0}+\dot{n}_{I0}) \quad [8.18]$$

where $\dot{n}_{I0}$ is the molar rate of inert gas, I, at y=0.

The molar rates per unit-cross-sectional area of the reactor ($a_r$) for the solid B is given as follows:

$$G_s=\frac{1}{a_r}\dot{n}_{BL} \quad [8.19]$$

where $\dot{n}_{BL}$ is the molar rate of B at y=L, which is the solid inlet for the reactor.

Using Eqs [8.17], [8.19], the Eq. [8.16] was rewritten as follows:

$$\frac{1}{1+1/K}\frac{d}{dy}(G_g(x_{A0}-x_{C0}/K)\theta)=\frac{1}{b}G_s\frac{dX}{dy} \quad [8.20]$$

where $x_{A0}$ and $x_{C0}$ is the mole fraction of A, and C, respectively, in the reducing gas mixture at the gas inlet, y=0.

For an isothermal operation, where the production rate is constant, the molar flux of reactants, both solids, and gas, entering the reactor will be constant. Additionally, the initial composition of the reactant gases, the equilibrium constant for the rate-limiting reaction, and the stoichiometric coefficient of the reaction are also constants. Thus, Eq. [8.20] can be rewritten as follows:

$$G_g\frac{(x_{A0}-x_{C0}/K)}{1+1/K}\frac{d\theta}{dy}=\frac{1}{b}G_s\frac{dX}{dy} \quad [8.21]$$

All the know parameters for the reaction can be grouped together into a term ($C_1$), and the Eq. [8.21] can be rearranged as follows:

$$C_1\frac{d\theta}{dy}=\frac{dX}{dy}\text{ where} \quad [8.22]$$

-continued $$C_1 = \frac{bG_g}{G_s}\frac{(x_{A0} - x_{C0}/K)}{1 + 1/K} \quad [8.23]$$

The position of the gas inlet (solid outlet) is given by y=0, and the solid inlet (gas outlet) is given by y=L. The boundary conditions for a moving bed reactor with counter-current flow is as follows:

$$\text{At } y = 0, \quad X = X_0, \quad \theta = 1 \quad [8.24]$$

$$\text{At } y = L, \quad X = 0, \quad \theta = \theta_L \quad [8.25]$$

The driving force of the gas at y=L, $\theta_L$ is set by the operator as a constant. Integrating Eq. [8.22], $$C_1(\theta-1)=X-X_0 \quad [8.26]$$

where θ and X are the normalized driving force, and degree of conversion, respectively, at any position along the length of the reactor.

As the bottom grate is moving at a constant speed ($u_0$), the molar rate of solid B per unit cross-sectional area is given as follows:

$$G_s=u_0\rho_B(1-\varepsilon_P)(1-\varepsilon_v) \quad [8.27]$$

where $\rho_B$ is the molar density of the solid B, and $\varepsilon_P$, and $\varepsilon_v$ is the porosity of the solid layer and the volume fraction of the free board, respectively.

Figure 23:
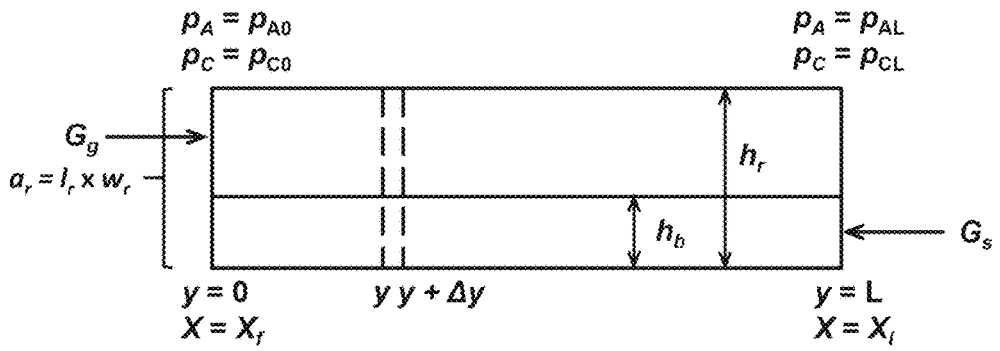
FIG. 23 shows a schematic of an exemplary counter-current moving bed reactor.

In FIG. 23, the free board is mathematically defined as follows:

$$\varepsilon_v = 1 - \frac{h_b}{h_r} \quad [8.28]$$

The velocity of the moving grate ($u_0$) is in the direction opposite to y, so Eq. [8.27] can be rewritten as:

$$G_s = -\rho_B(1 - \varepsilon_P)(1 - \varepsilon_v)\frac{dy}{dt} \quad [8.28]$$

In terms of velocity of the moving bed, the molar balance Eq. [8.21] can be rewritten as follows:

$$\frac{1}{b}G_s\frac{dX}{dy} = -\frac{1}{b}\rho_B(1 - \varepsilon_P)(1 - \varepsilon_v)\frac{dy}{dt}\frac{dX}{dy} \quad [8.29]$$

Applying the chain rule to Eq. [8.29] is rewritten in terms of the reduction rate.

$$G_s\frac{dX}{dy} = -\rho_B(1 - \varepsilon_P)(1 - \varepsilon_v)\frac{dX}{dt} \quad [8.30]$$

The rate of a reaction per unit volume of the solid bed under mixed control of particle kinetics and interparticle diffusion, which is the general case, can be obtained from the application of Sohn's Law of additive time.

Sohn's Law of additive time states that the time for a certain degree of conversion under mixed control (t) is the sum of the time for the time needed for reaching the same conversion under the control of particle kinetics ($t_r$), and the time needed for attaining the same conversion under control of interparticle diffusion ($t_d$). Mathematically, $$t=t_r+t_d \quad [8.31]$$

By differentiating Eq. [8.31] with respect to X, the following expression is obtained:

$$\frac{dt}{dX} = \left.\frac{dt}{dX}\right|_r + \left.\frac{dt}{dX}\right|_d \text{ where } \left.\frac{dt}{dX}\right|_r, \text{ and } \left.\frac{dt}{dX}\right|_d$$

are the rates of reduction under control of particle kinetics and under diffusion control, respectively. The conversion functions obtained under control of particle kinetics and interparticle diffusion were used to obtain closed-form expressions of $$\left.\frac{dt}{dX}\right|_r, \text{ and } \left.\frac{dt}{dX}\right|_d.$$

Rearranging Eq. [8.32], the rate of reduction under mixed control is expressed as follows:

$$\frac{dX}{dt} = \frac{1}{\left.\frac{dt}{dX}\right|_r + \left.\frac{dt}{dX}\right|_d} \quad [8.33]$$

In the case of the proposed ironmaking process, the conversion functions obtained under particle kinetics (g(X)) and interparticle diffusion control (p(X)) have the following forms:

$$g(X) \equiv [-\text{Ln}(1 - X)]^{1/m} \quad [8.34]$$

$$g(X) = k_o(p_A - p_C/K)t \quad [8.35]$$

$$p(X) \equiv 1 - \frac{F_p(1 - X)^{2/F_P} - 2(1 - X)}{F_p - 2} \quad [8.36]$$

$$P(X) = \frac{2bF_pD_e}{(1 - \varepsilon_P)\rho_B}\left(\frac{A_p}{F_pV_p}\right)^2\left(\frac{K}{K+1}\right)\frac{1}{RT}(p_A - p_c/K)t \quad [8.37]$$

From Eqs. [8.34] and [8.35], the following equation is obtained:

$$\left.\frac{dt}{dX}\right|_r = \frac{(1 - X)^{-1}(-\text{Ln}(1 - X))^{1/m-1}}{mk_o(p_A - p_C/K)} \quad [8.38]$$

For a flat layer of iron ore concentrate, the shape factor ($F_p$) and b for the rate-limiting reaction have values of 1 and ¼, respectively. The tortuosity used for calculating the effective diffusivity was obtained by fitting the one-step model to the experimental diffusion control conversion-time data as this method does not require any numerical calculations. Thus in the absence of any external mass transfer resistance, the reduction rate under interparticle diffusion control is obtained from Eqs. [8.36] and [8.37]:

$$\left.\frac{dt}{dX}\right|_d = \frac{(1 - \varepsilon_P)\rho_B}{bD_e}\left(\frac{V_P}{A_P}\right)^2\frac{RT(1 + 1/K)}{(p_A - p_C/K)}(X) \quad [8.39]$$

Combining Eqs. [8.33], [8.38], and [8.39], the rate of reduction under a mixed reaction control is given as follows:

$$\frac{dX}{dt} = \left( \frac{\left(\frac{p_A - p_C/K}{p_{A0} - p_{C0}/K}\right)}{\left(\frac{(1-X)^{-1}(-\mathrm{Ln}(1-X))^{1/m-1}}{mk_o p(x_{A0} - x_{C0}/K} + \frac{(1-\varepsilon_P)\rho_B}{bD_e}\left(\frac{V_P}{A_P}\right)^2 \frac{RT(1+1/K)}{p(x_{A0} - x_{C0}/K)} X\right)} \right) \quad [8.40]$$

The rate of reduction depends on the driving force of the reducing gas mixture. As the reactor is operating under pseudo-steady state conditions, the driving force of the reducing gas and the conversion at a particular position are related, and both are functions of position alone. Thus, the driving force term in the expression of the reaction rate, Eq. [8.40], can be replaced in terms of the conversion using Eq. [8.26].

$$\frac{dX}{dt} = \frac{1}{C_1} \cdot \frac{(C_1 + X - X_0)}{C_2(1-X)^{-1}(-\mathrm{Ln}(1-X))^{1/m-1} + C_3 X} \quad [8.41]$$

$$C_2 = \frac{1}{mk_0 p(x_{A0} - x_{C0}/K)} \quad [8.42]$$

$$C_3 = \frac{(1-\varepsilon_P)\rho_B}{bD_e}\left(\frac{y_p}{A_p}\right)^2 \frac{RT(1+1/K)}{p(x_{A0} - x_{C0}/K)} \quad [8.43]$$

$$L = C_1 C_4 \int_0^{X_0} \frac{C_2(1-X)^{-1}(-\mathrm{Ln}(1-X))^{1/m-1} + C_3 X}{C_1 + X - X_0} dX \quad [8.44]$$

$$C_4 = \frac{G_s}{\rho_B(1-\varepsilon_P)(1-\varepsilon_v)} \quad [8.45]$$

Equation [8.44] is integrated numerically using Simpson's Rule. At X=0, the integrand goes to infinity. Therefore, the integration was done starting with a small positive value of X (δ). This small value (δ) was reduced until the calculated value of the length of the reactor, L, was unaffected by a further decrease in the value of δ. A spreadsheet program, Microsoft Excel, was used for calculating the integral.

An Industrial Example

The output of a small-scale industrial ironmaking reactor is about 0.1 million metric ton of iron per year (Mtpy), which is equivalent to 12.66 metric ton/h assuming operation of 24 h/day and 330 days/year. It was also decided that the reactor will operate such that the overall conversion of solid leaving the reactor ($X_0$) is 0.95, a conversion of 95%. The reactor is operated under 1atm pressure. To maximize the reducing gas utilization, the normalized driving force of reducing gas, θ, is set at 0.3 at the gas outlet. The proposed MBR was assumed to have a rectangular cross-section with a width of 5 m and a height of 3 m. The calculated reactor dimensions are compared to a MIDREX reactor operating at a production rate of 110 metric ton/h. The rate of reduction increases if the gas-solid contact area increases. Thus, to have a conservative estimate of the rate of reduction, it was assumed that the iron concentrate layer was exposed to the reducing gas from only one surface.

Figure 24A:
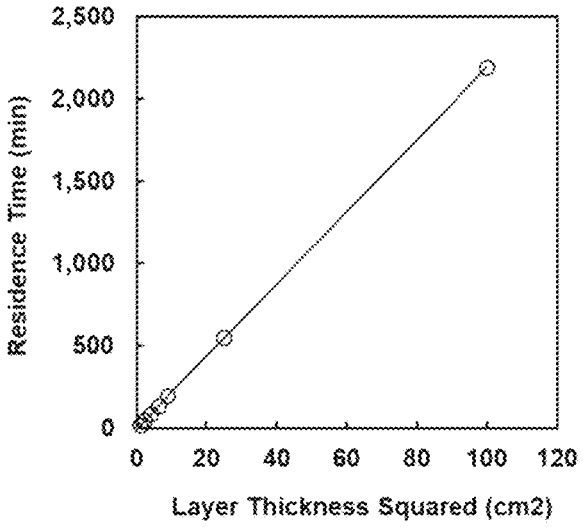
FIG. 24A-24B shows in an MBR operating at 1000° C. (24A) plot of residence time vs. square of layer thickness for a given production rate; (24B) plot of reactor length as a function of layer thickness for two production rates.
Figure 24B:
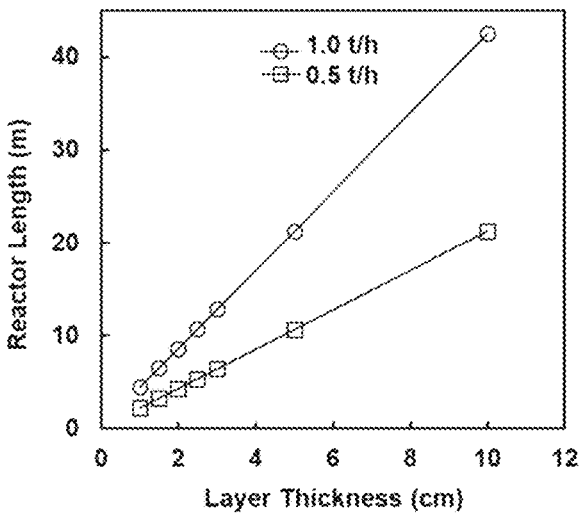

The production rate from a single layer of concentrate depends on the width and thickness of the layer and the reaction rate under the operating conditions. In the MBR, it is desired that the reduction occur under the control of interparticle diffusion, as this is the fastest possible rate. For a layer of a specific width, reacting under interparticle diffusion control, the residence time is proportional to the square of the thickness (characteristic length) of the iron ore concentrate layer, as is demonstrated in FIG. 24A. When the production rate is set at a specific value, the length of the reactor increases linearly with the increase in layer thickness, as can be observed from FIG. 24B.

At a fixed rate of production, there is a choice between a short reactor with a shallow bed and a long reactor with a deep bed. A deeper bed needs a longer residence time; the length of the reactor has to be increased. As the bed depth is decreased, the reaction may no longer be diffusion controlled, thus requiring a longer reactor than under diffusion control. From the kinetics of magnetite reduction, it was found that between 650-1000° C., for a layer (bed) thickness of 1 cm it was largely controlled by interparticle diffusion. Thus, this reactor design considered that the layer (bed) thickness will be equal to or greater than 1 cm.

An industrial MBR would need to have multiple layers of concentrate to utilize the entire volume of the reactor. The greater the number of layers, the more moving parts inside the reactor, which can lead to increased operational and maintenance costs. Therefore, for the purpose of this work, it was decided that the reactor will have at most 10 layers. For the dimensions of MBR to be comparable with other industrial reactors, it was decided that the length of the reactor has to be under 50 m.

For a 0.1 Mtpy ironmaking operation, the effect of reaction temperature and layer thickness on residence time, reactor length, grate speed, and linear gas velocity is presented in Table 8.1.

TABLE 8.1

| Temperature (° C.) | Layer Thickness (cm) | Residence Time (min) | Reactor Length (m) | Grate Speed (cm/min) | Gas Velocity (cm/s) |
|---|---|---|---|---|---|
| 1000 | 1 | 23.5 | 5.76 | 24.5 | 182 |
| | 2 | 92 | 11.3 | 12.3 | 188 |
| | 5 | 571 | 28.1 | 4.91 | 211 |
| 900 | 1 | 28.7 | 7.03 | 24.5 | 182 |
| | 2 | 108 | 13.3 | 12.3 | 188 |
| | 5 | 661 | 32.4 | 4.91 | 211 |
| 850 | 1 | 32.1 | 7.87 | 24.5 | 183 |
| | 2 | 118 | 14.5 | 12.3 | 189 |
| | 5 | 718 | 35.3 | 4.91 | 212 |
| 650 | 1 | 95 | 23.3 | 24.5 | 196 |
| | 2 | 371 | 45.6 | 12.3 | 203 |
| | 5 | 2303 | 113.1 | 4.91 | 227 |

It was observed that for a given layer thickness, the residence time and the reactor length decreased on increasing temperature. The grate speed was unaffected by temperature as is expected from the diffusion-controlled reaction conditions. The linear gas velocity increased slightly on decreasing operating temperature. For a given temperature, increasing the layer thickness resulted in longer residence time, longer reactor lengths, and slower speed of moving grate. The linear gas velocity also increased with increasing layer thickness as the free board in the reactor decrease. The demand for gas increased with decreasing temperature as the composition of hydrogen-water vapor mixture in equilibrium with a wüstite iron system is more hydrogen rich at a lower temperature, making the concentration driving force smaller.

Based on the data it was found that an MBR with a layer (bed) thickness of 2 cm and 45.6 m long can operate at 650° C. The design parameters and the operating conditions of the MBR were calculated at four temperatures, for reactors operating with a layer thickness of 2 cm and the results are presented in Table 8.2.

TABLE 8.2

| Operating Conditions/ Design Parameters | MBR | MBR | MBR | MBR |
|---|---|---|---|---|
| Temperature (° C.) | 1000 | 900 | 850 | 650 |
| Characteristic Length (cm) | 2 | 2 | 2 | 2 |
| Gas Flow Rate ($Nm^3/h$) | 20350 | 20400 | 20500 | 21950 |
| Residence Time (min) | 92 | 108 | 118 | 371 |
| Speed of Grate (cm/min) | 12.3 | 12.3 | 12.3 | 12.3 |
| Reactor Length (m) | 11.3 | 13.3 | 14.5 | 45.6 |
| Reactor Volume ($m^3$) | 170 | 200 | 218 | 684 |

A comparison of the design parameters and operating conditions for the MBR and a typical MIDREX reactor is presented in Table 8.3. A MIDREX reactor was chosen because of its wide prevalence in the field of alternative ironmaking. A direct comparison is not meaningful as the two reactors have different underlying technology and production rate. However, the MIDREX is a more compact reactor. Due to its vertical design, a MIDREX reactor has a much smaller footprint compared to the MBR. The advantage of the MBR is that it can operate at a much lower temperature compared to the MIDREX which means lower energy consumption and lower maintenance cost.

TABLE 8.3

| Operating Conditions/ Design Parameters | MBR 1 | MBR 2 | A MIDREX Reactor |
|---|---|---|---|
| Production Rate (metric ton/h) | 12.66 | 12.66 | 110 |
| Temperature (° C.) | 650 | 900 | 920 |
| Ore Gangue Content (wt %) | 4 | 4 | <4 (preferred) |
| Degree of Conversion (%) | 95 | 95 | 94.8 |
| Pellet porosity (—) | 0.5 | 0.5 | 0.23 |
| Characteristic Length (cm) | 2 | 2 | 0.5-0.6 |
| Number of Layers (—) | 10 | 10 | — |
| Gas Pressure (atm) | 1.00 | 1.00 | 1.33 |
| Gas Flow Rate ($Nm^3/h$) | 21950 | 20400 | 170000 |
| Residence Time (min) | 371 | 108 | ~180 |
| Speed of Grate (cm/min) | 12.3 | 12.3 | — |
| Reactor Volume ($m^3$) | 684 | 200 | ~246.3 |
| Free Board (—) | 0.93 | 0.93 | 0.56 |

Figure 25:
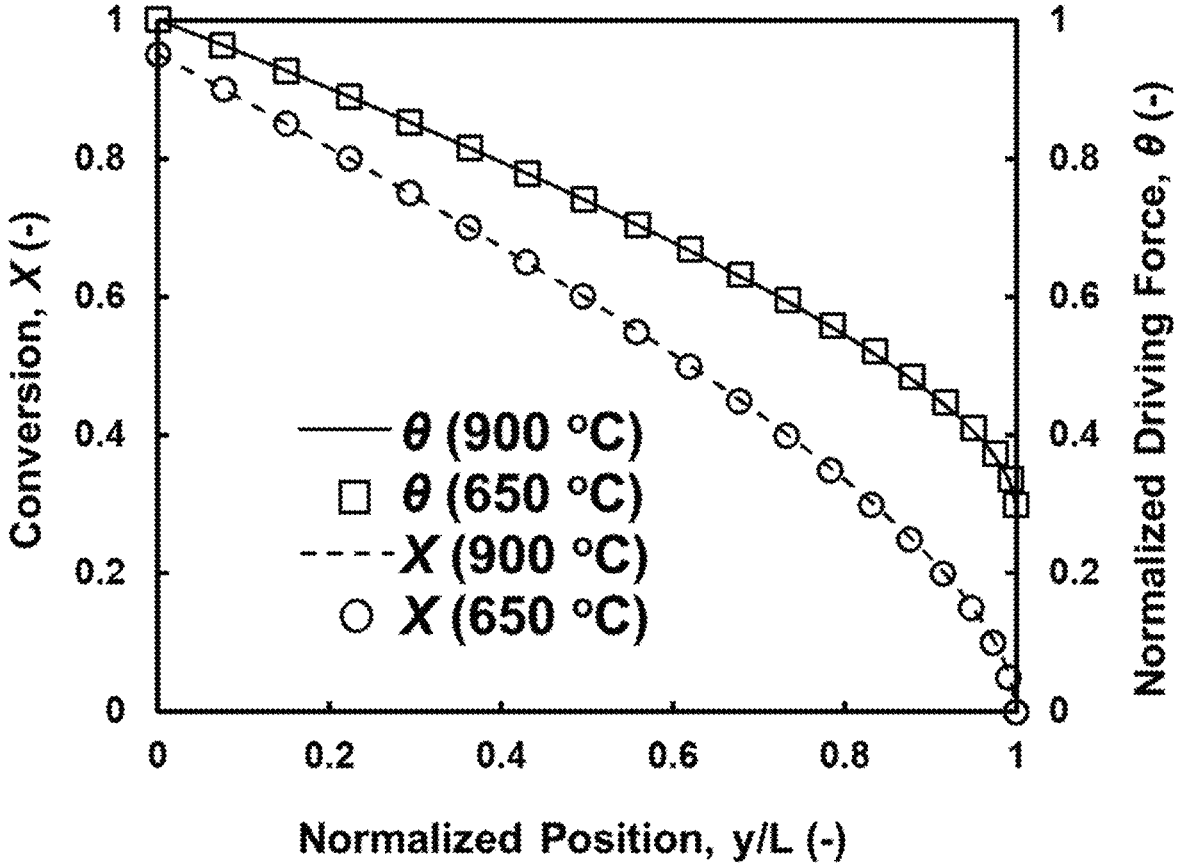
FIG. 25 shows the conversion and normalized partial pressure profile over the normalized length of the moving bed reactor at 650° C. and 900° C. (1 atm pressure).

The degree of conversion (X) and the driving force of the reacting gas (θ) was calculated for positions along the MBR. FIG. 25 shows the conversion and driving force along the normalized length (y/L), where L is the total length of the MBR, for reactors operating at 650° C. and 900° C. The nature of the shape of the curves representing the conversion and normalized driving force along the normalized length of the reactor does not change appreciably when the operating temperature is varied. This is because the rate of reduction is fastest when the reactor is operated under the control of interparticle diffusion and increasing temperature further does not increase the rate of reduction.

Concluding Remarks

To summarize, the discussion on the MBR for industrializing the proposed ironmaking technology the following can be stated:

1. The proposed ironmaking technology can be implemented in an MBR operating at temperatures between 650-1000° C. for a small-scale ironmaking operation producing 0.1 Mtpy.
2. The design parameters and the operating conditions for the MBR were compared to a MIDREX reactor. The MBR reactor was found to need a larger reactor volume compared to the MIDREX. However, due to significantly lower temperature of operation and the elimination of the pelletization step, the lower energy consumption, $CO_2$ emissions, and maintenance costs are expected to compensate for the need for a larger volume and reactor footprint.
3. A simple yet general model for a MBR has been presented. This can be adapted to other non-catalytic gas-solid reactions, for which the rate of reaction is known, in order to obtain the design parameters and operating conditions.

CONCLUSIONS

In this work, an alternative hydrogen ironmaking process has been proposed, and the technical feasibility of an industrial operation based on this process has been established through experiments and modeling. The significant findings from this work are summarized in this section.

The global particle kinetics of reduction of iron ore concentrate by hydrogen was established over the temperature range of 500-1000° C., which is specific to the proposed process. The reduction rate over the entire range was best described by a nucleation and growth equation with an Avrami parameter (n) of 1.5, and the reduction rate had a first-order dependence on the partial pressure of hydrogen. The particle kinetics decreased with an increase in temperature between 650-800° C.

It was demonstrated that the reduction of a bed of magnetite concentrate by hydrogen under the control of interparticle-diffusion could be modeled as a single step reaction by considering that the overall reaction is limited by the $H_2$—$H_2O$—Fe—FeO equilibrium. This results in an approximate closed-form equation describing the conversion-time relationship for iron ore concentrate reduction under the control of interparticle-diffusion. A significant advantage of this equation form was that the interparticle-diffusion controlled rate and the particle kinetics could be used to calculate conversion-time relationship for mixed controlled cases without numerical computation by directly applying Sohn's Law of additive reaction time.

A moving bed reactor used for the proposed technology was modeled incorporating the rate equations developed for the mixed control reaction. The design parameters and the operating conditions were found for reactors operating between 650-1000° C. for a small-scale ironmaking operation producing 0.1 Mtpy. The significant advantages of this technology are lower temperature of operation and the elimination of the pelletization step. Compared to other alternative ironmaking technologies, this means lower energy consumption, $CO_2$ emissions, and maintenance cost.

In addition, unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it may be taken to mean an amount, value or condition that deviates by less than 20%, less than 10%, less than 5%, less than 1%, less than 0.1%, or less than 0.01% of the stated amount, value, or condition.

As used herein, the term "between" includes any referenced endpoints. For example, "between 2 and 10" includes both 2 and 10.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise.

Unless otherwise stated, all percentages, ratios, parts, and amounts used and described herein are by weight.

Some ranges may be disclosed herein. Additional ranges may be defined between any values disclosed herein as being exemplary of a particular parameter. All such ranges are contemplated and within the scope of the present disclosure.

The phrase 'free of' or similar phrases if used herein means that the composition or article comprises 0% of the stated component, that is, the component has not been intentionally added. However, it will be appreciated that such components may incidentally form thereafter, under some circumstances, or such component may be incidentally present, e.g., as an incidental contaminant.

The phrase 'substantially free of' or similar phrases as used herein means that the composition or article preferably comprises 0% of the stated component, although it will be appreciated that very small concentrations may possibly be present, e.g., through incidental formation, contamination, or even by intentional addition. Such components may be present, if at all, in amounts of less than 1%, less than 0.5%, less than 0.25%, less than 0.1%, less than 0.05%, less than 0.01%, less than 0.005%, less than 0.001%, or less than 0.0001%. In some embodiments, the compositions or articles described herein may be free or substantially free from any specific components not mentioned within this specification.

The present systems and methods are also described in the context of being free from various reactor configurations or components described in various prior references, such as fluidized beds, fluidized bed reactors, suspension reduction, flash reduction, use of a belt furnace with long residence times, use of a shaft furnace where oxygen and hydrogen are injected into the reduction section of the shaft furnace, or use of a rotary kiln and associated hydrogen spray gun and rotary cooling cylinder. In any embodiment, any of such components may be absent from the presently contemplated systems and methods. Similarly, the use of coke, CO, or other reducing agents including a higher fraction of carbon to hydrogen that natural gas (e.g., $CH_4$) may also be avoided for reduction of iron within the present processes, as such materials predominantly generate $CO_2$, rather than $H_2O$ as oxygen is removed from the iron ore, during upgrading.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

Disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure. Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects are, however, also contemplated herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A method for producing iron from iron concentrate produced from low grade iron ore including no more than about 35 wt % iron in a continuous moving bed conveyor reactor, the method comprising the steps of:

providing iron ore concentrate in a small particle form of no more than about 0.1 mm particle size, where the iron ore concentrate has not undergone pelletization and/or induration; and passing the iron ore concentrate that has not undergone pelletization and/or induration through a moving bed conveyor reduction furnace with at least one of hydrogen gas or natural gas, wherein the iron ore concentrate that has not undergone pelletization and/or induration is present within the conveyor reduction furnace in a layer that is no more than about 5 cm thick, the hydrogen gas or natural gas reducing the iron ore concentrate, so as to remove oxygen therefrom, and converting the iron ore concentrate material to a material having a composition similar to direct reduced iron (DRI) or sponge iron product, having about 90-95 wt % iron, up to about 10 wt % oxygen, with other trace impurities, wherein the furnace is operated at a temperature in a range of 850-1000° C.

2. The method as recited in claim 1, wherein energy consumption is reduced by 30-50% compared with an average blast furnace, and/or $CO_2$ emissions are reduced by 60-95%, depending on whether natural gas or hydrogen is used for reduction.

3. The method as recited in claim 1, wherein the moving bed conveyor reduction furnace is a countercurrent reactor, with flow of the hydrogen or natural gas flowing countercurrent to movement of the iron ore concentrate.

4. The method as recited in claim 1, wherein the iron ore concentrate that has not undergone pelletization and/or induration is present within the conveyor reduction furnace in a layer that is from about 1 to about 5 cm thick.

5. The method as recited in claim 1, wherein reaction rate is predominantly controlled by interparticle diffusion rather than temperature.

6. The method as recited in claim 1, wherein the furnace is operated at a temperature in a range of 850-950° C.

7. The method as recited in claim 1, wherein the iron ore concentrate is fed into the furnace on a moving grate or in trays on a moving conveyor belt.

8. The method as recited in claim 1, wherein hydrogen gas is used as the reductant, the method producing no significant $CO_2$ emissions.

9. A method for producing iron from iron concentrate produced from low grade iron ore including no more than about 35 wt % iron in a continuous moving bed conveyor reactor, the method comprising the steps of:

providing iron ore concentrate in a small particle form of no more than about 0.1 mm particle size, where the iron ore concentrate has not undergone pelletization and/or induration; and passing the iron ore concentrate that has not undergone pelletization and/or induration through a moving bed conveyor reduction furnace with at least one of hydrogen gas or natural gas, wherein the iron ore concentrate that has not undergone pelletization and/or induration is present within the conveyor reduction furnace in a layer that is no more than about 5 cm thick, the hydrogen gas or natural gas reducing the iron ore concentrate, so as to remove oxygen therefrom, and converting the iron ore concentrate material to a material having a composition similar to direct reduced iron (DRI) or sponge iron product, having about 90-95 wt % iron, up to about 10 wt % oxygen, with other trace impurities, wherein the furnace is operated at a temperature in a range of 850-1000° C.;

wherein the iron ore concentrate is provided as two or more layers configured as stacked beds, with space provided between each stacked bed, to allow the hydrogen or natural gas to flow over each of the stacked beds, reducing the iron ore concentrate within each such bed, wherein the system includes from 2 to about 10 stacked beds.

* * * * *